US005360965A

United States Patent [19]

Ishii et al.

[11] Patent Number: 5,360,965

[45] Date of Patent: Nov. 1, 1994

[54] MICROWAVE OVEN WITH AUTOMATIC COOKING MODE SELECTING FUNCTION

[75] Inventors: Kazunori Ishii, Tajimi; Hisao Kano, Aichi; Nobuichi Nishimura, Ichinomiya; Masayuki Aoki, Inuyama; Yukio Suzuki, Aichi; Takamichi Sujaku, Nagoya; Yoshio Okamura, Nagoya; Masahiko Wada, Nagoya; Takumi Ohno, Nagoya; Ryuho Narita, Yokohama, all of Japan

[73] Assignee: Kabushiki Kaisha Toshiba, Kanagawa, Japan

[21] Appl. No.: 28,258

[22] Filed: Mar. 9, 1993

[30] Foreign Application Priority Data

Mar. 13, 1992 [JP] Japan ..... 4-055460

[51] Int. Cl.[5] ..... H05B 6/68

[52] U.S. Cl. ..... 219/705; 219/707; 219/685; 219/762; 219/754

[58] Field of Search ..... 219/10.55 B, 10.55 E, 219/10.55 F:10.55 R, 704, 705, 707, 709, 734, 735, 732, 754, 762, 763, 685

[56] References Cited

U.S. PATENT DOCUMENTS 4,447,692 5/1984 Mierzwinski ..... 219/10.55 B
4,471,195 9/1984 Ishii et al. ..... 219/10.55 E
4,625,086 11/1986 Karino ..... 219/10.55 B

FOREIGN PATENT DOCUMENTS

3138025A1 5/1982 European Pat. Off. .
55-49845 12/1980 Japan .
61-61514 12/1986 Japan .
63-60805 4/1988 Japan .
3-49006 7/1991 Japan .
4-10389 1/1992 Japan .
4-38116 6/1992 Japan .

*Primary Examiner*—Philip H. Leung
*Attorney, Agent, or Firm*—Limbach & Limbach

[57] ABSTRACT

A microwave oven includes a heating chamber, a plurality of cooking utensils detachably disposed in the heating chamber selectively in accordance with the cooking contents, a plurality of heat sources heating food placed on or contained in the cooking utensil and including a magnetron, an oven heater and a grill heater, optical sensors determining the cooking utensil disposed in the heating chamber, and a microcomputer. The cooking utensils include a glass dish, thawing gridiron, pot, upper and lower top plates, one-legged top plate, and gridiron. A microwave cooking mode is selected when the determination of the optical sensors indicates that neither upper nor lower top plate is present in the heating chamber. A heater cooking mode is selected when either upper or top plate is present. When the heater cooking mode is selected on the basis of presence of the upper top plate, either an oven mode or a grill mode is selected depending upon presence or absence of the gridiron. One of the heat sources in accordance with the selected cooking mode is controlled on the basis of a cooking program of the selected cooking mode by the microcomputer.

15 Claims, 26 Drawing Sheets

MICROWAVE OVEN WITH AUTOMATIC COOKING MODE SELECTING FUNCTION

BACKGROUND OF THE INVENTION

1. Field of the Invention

This invention relates to microwave ovens equipped with heaters together with a magnetron, and more particularly to such microwave ovens wherein a cooking utensil disposed in a heating chamber is determined for the purpose of determination of a cooking mode and food placed on or contained in the cooking utensil is determined so that heating is automatically executed in accordance with the determined cooking mode and the determined food.

2. Description of the Prior Art

Multi-function type microwave ovens have recently been commercially provided. The multi-function type microwave oven is equipped with an oven heater and a grill heater together with a magnetron, and cooking can be executed in a number of cooking modes. These cooking modes are roughly classified into a microwave cooking mode wherein food is heated by means of microwaves and a heater cooking mode wherein the food is heated by either heater. The microwave cooking mode is classified into a warming mode, a thawing mode wherein frozen raw food is thawed, and a pot-used cooking mode wherein an exclusive pot is used for the cooking. The heater cooking mode is classified into an oven mode wherein an atmosphere in the heating chamber is heated to a high temperature for the cooking and a grill mode wherein radiant heat generated by the heater is employed for the cooking.

The above-described multi-function type microwave oven is provided with an automatic cooking function. In the automatic cooking, a user operates one of a plurality of switches to select a desired cooking mode in accordance with cooking contents. Then, when desired one of a number of cooking menus is selected by operation of a switch, an incorporated microcomputer operates to automatically execute the cooking on the basis of a cooking menu program in accordance with the selected cooking mode and the selected cooking menu.

In the conventional multi-function type microwave oven, however, the user needs to selectively operate one of the switches to select the desired cooking mode and he or she further needs to operate one of the switches to select the desired cooking menu. Thus, the operation for selection of the desired cooking mode and the desired cooking menu is troublesome.

Furthermore, mistakes in selection of the switch could occur since a number of switches are provided. Cooking utensils are specified for every cooking mode. Accordingly, when a mistake in selection of the cooking mode occurs, for example, when the microwave cooking mode is mistakenly selected for the oven cooking with a metal top plate, the microwaves are supplied to the heating chamber, where sparks occur around the metal top plate.

Furthermore, in the case where the oven cooking mode is mistakenly selected when the food contained in a plastic receptacle is warmed by way of microwaves, the plastic receptacle would be melted. On the other hand, mistakes in selection of the cooking menu could occur. In this case, a desirable cooking cannot be performed.

Japanese Published Utility Model Registration Application (Kokai) No. 63-60805 discloses a technique for preventing the mistake in selecting the cooking mode such as described above. In this publication, it is determined which the cooking utensil disposed in the heating chamber is, a cooking gridiron used in the grill cooking or a thawing gridiron used in the thawing. In case that the thawing mode is mistakenly selected in the use of the cooking gridiron or that the grill mode is selected in the use of the thawing gridiron, the mistake is informed by a speaker. However, this publication relates to alarming in the case of mistake in selection of the cooking mode but does not disclose reduction in the number of the operation switches for prevention of the mistake in the cooking mode selecting operation.

Japanese Published Patent Application (Kokoku) Nos. 3-49006 and 4-38116 disclose the technique for reducing the number of switches in the microwave oven of the above-described type. In these publications, cooking menus of "GRATIN" and "BROILED SALTED FISH" in the grill cooking are determined on the basis of output changes of a sensor sensing a used receptacle and the heating is automatically controlled so that an optimum finishing can be obtained. Furthermore, in another Japanese Published Patent Application (Kokoku) No. 61-61514, a gas sensor and a thermal element are provided so that setting keys for respective kinds of cooking modes in the warming cooking in the microwave cooking are eliminated, and a control device determines the kind of food on the basis of rate of change with time in an output signal of the gas sensor after initiation of the heating. The magnetron is deenergized when the output signals of the gas sensor and the thermal element reach predetermined levels respectively.

The above-mentioned publications disclose only determination of the desired cooking menu in the warming mode in the grill cooking or the microwave cooking. However, these publications do not disclose the automatic determination of the desired cooking mode in the multi-function type microwave oven provided with various kinds of cooking mode such as the warming mode, thawing mode, pot-used cooking mode, oven mode and grill mode. Consequently, the troublesomeness in the cooking mode selecting operation and the mistake in the selection of the cooking mode in the multi-function type microwave oven cannot be solved by the above-mentioned publications.

On the other hand, it has been proposed to automatically select and set the desired cooking mode by determining the cooking utensil disposed in the heating chamber. However, the cooking utensils for the multi-function type microwave oven include two kinds of top plates, that is, an upper top plate and a lower top plate. The lower top plate is used exclusively in the oven cooking while the upper top plate is used both in the oven cooking and in the grill cooking. Accordingly, the determination cannot be made as to which is selected, the oven or grill mode and the range of automatic selection of the cooking modes is narrowed.

SUMMARY OF THE INVENTION

Therefore, a primary object of the present invention is to provide an improved microwave oven which is provided with the heaters together with the magnetron and wherein the range for automatic selection of the cooking mode can be increased and a heat source in accordance with the selected cooking mode can be controlled in accordance with the cooking program for the selected cooking mode.

A second object of the invention is to provide an improved microwave oven wherein the kind of food to be cooked can be automatically determined after the selection of the cooking mode and the cooking menu in accordance with the selected cooking mode can be selected and executed so that the heating can be performed in accordance with the food.

In one aspect, the present invention provides a microwave oven comprising a heating chamber and a plurality of cooking utensils detachably disposed in the heating chamber selectively in accordance with cooking contents, the cooking utensils including at least an upper top plate, and a lower top plate disposed up and down in the heating chamber respectively and a food holder placed on the upper top plate. A plurality of heat sources are provided for heating food placed on or contained in at least one of the cooking utensils. The heat sources include a magnetron, an oven heater and a grill heater. Cooking utensil detecting means is provided for detecting the cooking utensil disposed in the heating chamber. Cooking mode selecting means is connected to the working utensil detection means for selecting one of a plurality of cooking modes in accordance with a result of detection by the cooking utensil detecting means. The cooking mode selecting means selects a microwave cooking mode when the result of detection by the cooking utensil detecting means indicates that neither the upper nor the lower top plate is present in the heating chamber. The cooking mode selecting means selects a heater cooking mode when the result of detection by the cooking utensil detecting means indicates that either the upper or the lower top plate is present in the heating chamber. The cooking mode selecting means selects either an oven mode or a grill mode on the basis of presence or absence of the food holder on the upper top plate when the heater cooking mode has been selected. Control means is connected to the cooking utensil detecting means for controlling any one of the magnetron, the oven heater and the grill heater ill accordance with the cooking mode selected by the cooking mode selecting means on the basis of a cooking program according to the selected cooking mode. In particular, the determination of either the oven or grill mode can be reliably performed and the range for the automatic selection of the cooking mode can be increased.

The cooking utensils used individually or in combination with another cooking utensil in accordance with each cooking mode are detected. Although three kinds of cooking modes including the microwave cooking mode, the oven mode and the grill mode are provided and the upper top plate is used either in the oven or in the grill mode, the cooking mode can be selected and set reliably by the detection of the cooking utensils disposed in the heating chamber. Consequently, one of the heat sources can be reliably selected and the food can be cooked in the desired cooking mode and the distinction between the oven and grill modes can be particularly performed reliably, which increases the range of automatic selection of the cooking modes.

The food holder placed on the upper top plate may include a gridiron. In this case, the cooking mode selecting means may select the oven mode when the result of detection indicates that the gridiron is absent on the upper top plate while the means may select the grill mode when the result of detection indicates that the gridiron is present on the upper top plate.

In another aspect, the invention provides a microwave oven a heating chamber and a magnetron and a heater each heating food accommodated in the heating chamber. A plurality of cooking utensils are detachably disposed in the heating chamber and include top plates used in the heating by the heater and a plurality of microwave cooking utensils used in the heating by the magnetron selectively in accordance with cooking contents. Cooking utensil detection means is provided for detecting the cooking utensil disposed in the heating chamber. Cooking mode selecting means is connected to the cooking utensil detecting means for selecting a heater cooking mode when the result of detection by the cooking utensil detecting means indicates that the top plate is present in the heating chamber, and for selecting any one of a warming mode, a thawing mode and a pot-used cooking mode, each included in a microwave cooking mode, in accordance with the result of detection of the microwave cooking utensil by the cooking utensil detecting means when the result of detection by the cooking utensil detecting means indicates that no top plate is present in the heating chamber. Control means is connected to the cooking mode selecting means for controlling either the magnetron or the heater in accordance with the cooking mode selected by the cooking mode selecting means on the basis of a cooking program according to the selected cooking mode.

Although the microwave cooking mode includes three kinds of modes, that is, the warming, thawing and pot-used cooking modes, the cooking utensil differs in the three modes. Accordingly, the cooking mode can be reliably selected and set by the detection of the cooking utensil disposed in the heating chamber. Consequently, when the food is heated by the magnetron, the magnetron can be controlled in accordance with the cooking contents of the warming, thawing or pot-used cooking.

The microwave oven may be further provided with an alcohol sensor connected to the control means for detecting alcohol present in the heating chamber and a height sensor connected to the control means for detecting the height of a receptacle containing food so that the food can be distinguished between Japanese saké and milk. In this case of the warming mode in the microwave cooking mode, when the presence of alcohol has been detected by the alcohol sensor before initiation of heating by the magnetron, the control means determines that the food contained in the receptacle is Japanese saké. When the absence of alcohol has been detected and the height of the receptacle detected by the height sensor has been at a predetermined value or above, the control means determines that the food contained in the receptacle is milk. The control means selects and executes the cooking menu in accordance with the results of determination.

The microwave oven may be further provided with a height sensor connected to the control means for detecting the height of the food placed on either top plate on the basis of the height of a peripheral wall of either top plate. In the oven mode, the control means may determine the kind of the food on the basis of a result of detection by the height sensor.

The microwave oven may be further provided with a weight sensor connected to the control means for detecting the weight of the food placed on either top plate, photographing means for photographing the food from above, and image processing means for calculating an area of the food from image information supplied from the photographing means together with the alcohol sensor connected to the control means for detecting alcohol in the heating chamber. In the grill mode, when the alcohol has been detected by the alcohol sensor connected to the control means before initiation of heating, the control means determines that the food belongs to a specific cooking group. On the other hand, when determining that the food belongs to a cooking group other than the specific one, the control means determines the kind of the food on the basis of concentration of alcohol detected by the alcohol sensor after initiation of heating, the weight of the food detected by the weight sensor and the area of the food calculated by the image processing means.

Other objects of the present invention will become obvious upon understanding of the illustrative embodiment about to be described. Various advantages not referred to herein will occur to those skilled in the aft upon employment of the invention in practice.

BRIEF DESCRIPTION OF THE DRAWINGS

An embodiment of the invention will be described, merely by way of example, with reference to the accompanying drawings, in which.

DESCRIPTION OF THE PREFERRED EMBODIMENT

One embodiment of the present invention will be described with reference to the accompanying drawings. In the embodiment, the invention is applied to a multi-function type microwave oven provided with an oven function and a grill function as well as an electronic range function.

Figure 1:
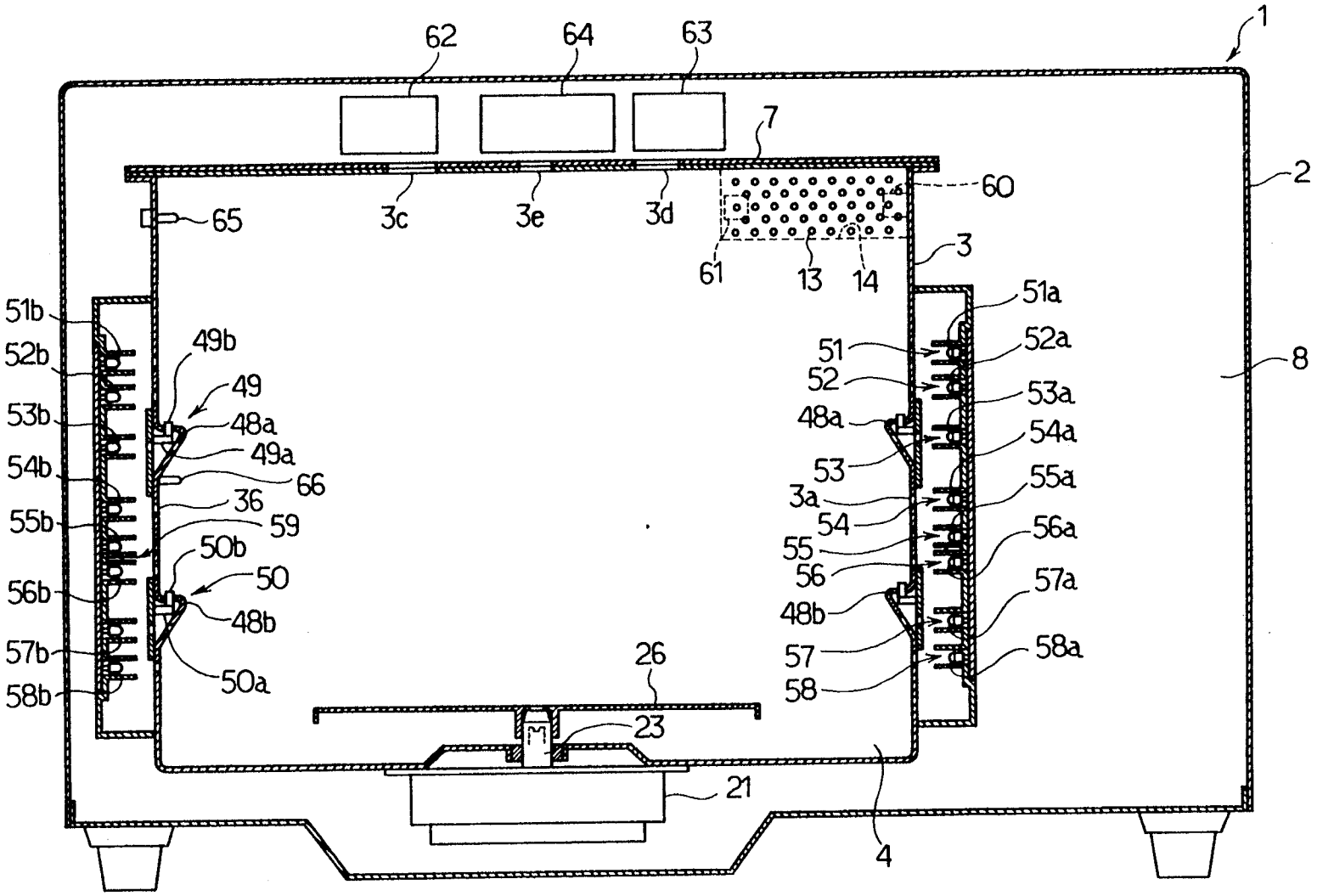
FIG. 1 is a longitudinally sectional front view of the microwave oven in accordance with one embodiment of the present invention.

FIG. 1 shows an overall construction of the microwave oven. As shown, a casing 1 includes an outer casing 2 and an inner casing 3. The interior of the inner casing 3 serves as a heating chamber 4. The microwave oven is provided with a magnetron 5, an oven heater 6 and a grill heater 7 serving as heating means or heat sources for heating food contained in the heating chamber 4. The grill heater 7 is disposed on a ceiling of the inner casing 3 such that heat generated by the grill heater 7 is radiated into the heating chamber 4 from above.

Figure 2:
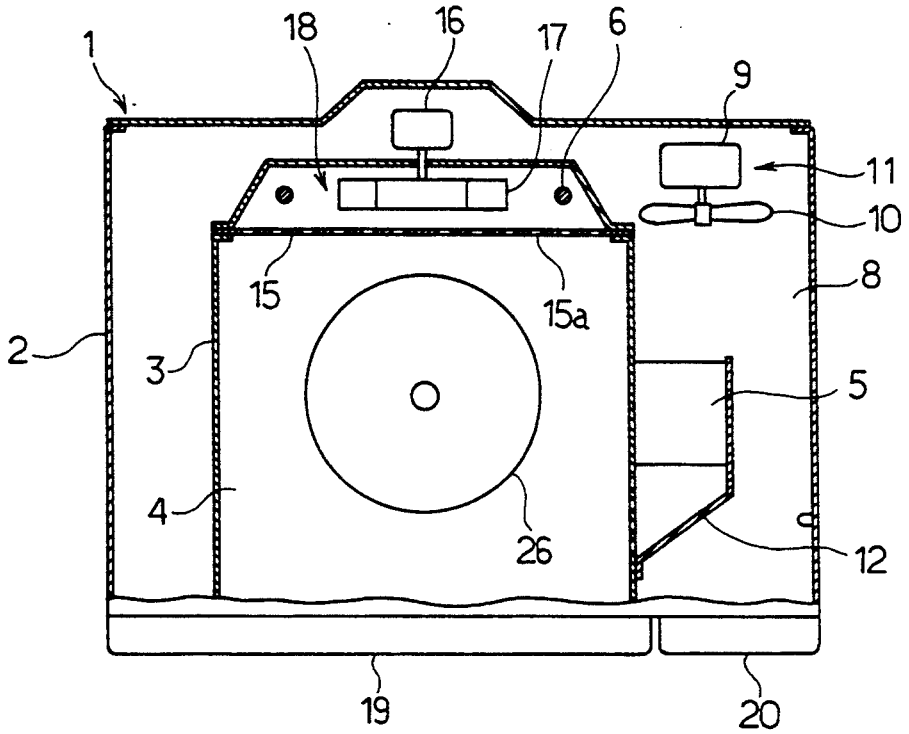
FIG. 2 is a transversely sectional plan view of the microwave oven.

A space at the right-hand side of the inner casing 3 in the casing 1 serves as an instrument compartment 8. The magnetron 5 is disposed in the instrument compartment 8 as shown in FIG. 2. Microwaves radiated from the magnetron 5 are fed into the heating chamber 4 through a waveguide (not shown). A cooling fan 11 is also disposed in the instrument compartment 8. The cooling fan 11 comprises a fan motor 9 and a propeller-shaped fan blade 10. Outside air is taken in by the cooling fan 11 to be fed as cooling air to the magnetron 5. A part of the cooling air passing the magnetron 5 is fed into the heating chamber 4 through a duct 12. The air fed into the heating chamber 4 is exhausted to the outside from an outlet 13 through an exhaust duct 14.

A circulation fan 18 is provided in the rear of a partition plate 15 composing a rear portion of the inner casing 3. The circulation fan 18 comprises the oven heater 6, a fan motor 16 and a centrifugal fan 17 mounted on the fan motor 16. The air in the heating chamber 4 is taken in by the circulation fan 18 through central vent holes 15*a* formed in the partition plate 15 and is fed to the oven heater 6 such that the heated air is fed into the heating chamber 4 through peripheral vent holes 15*a*. A door 19 is provided for closing and opening the front of the heating chamber 4 and reference numeral 20 designates an operation panel as shown in FIG. 2.

Figure 3:
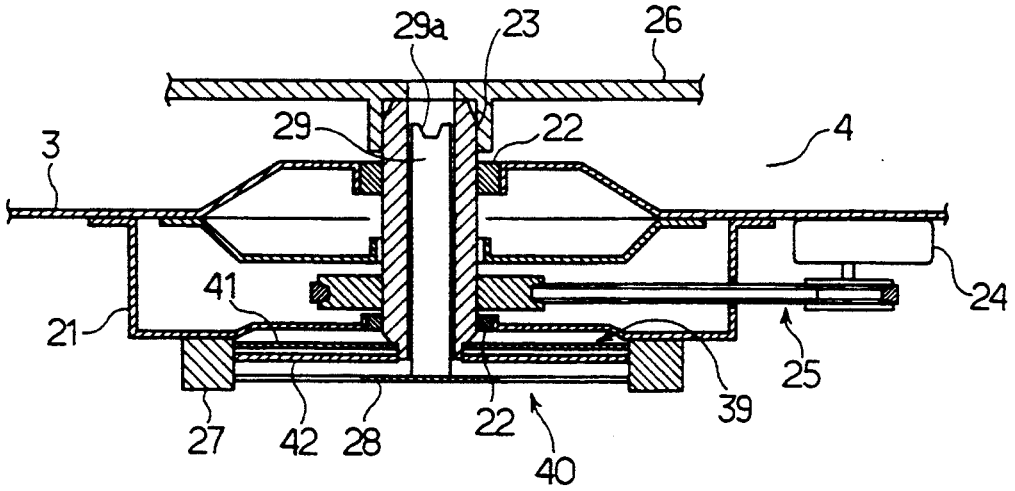
FIG. 3 is an enlarged longitudinally sectional front view of the turntable and the mechanism for driving the turntable.

A housing 21 is fixed to the underside of the inner casing 3 as shown in FIG. 3. Two bearings 22 are mounted on the bottom of the housing 21 and the bottom of the inner casing 3 respectively. A hollow rotating shaft 23 is held on both bearings 22. The rotating shaft 23 is coupled via a belt transmission mechanism 25 to a motor 24 mounted on the inner bottom of the heating chamber 4. A metal turntable 26 is mounted on an upper end of the shaft 23 extending into the interior of the heating chamber 4 such that the turntable 26 is turned upon start of the motor 24. A pair of support members 27 are secured to the underside of the housing 21 to be opposed to each other. A mounting plate 28 is secured to the inner side of each support member 27. A stationary shaft 29 is secured to the mounting plate 28 so as to be upright and is inserted in the hollow rotating shaft 23.

As obvious from the above-described kinds of heat sources, the multifunction type microwave oven of the embodiment can perform an oven cooking, a grill cooking as well as a microwave cooking. Furthermore, the microwave cooking is classified into a warming mode wherein rice or dishes are warmed, a thawing mode wherein frozen food such as meat or sliced raw fish or "sashimi," and a pot-used cooking mode in the embodiment. A cooking utensil containing food is placed in the heating chamber in the case of each above-described cooking mode.

Figure 5:
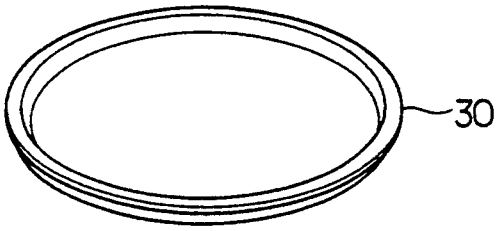
FIG. 5 is a perspective view of a glass dish used in the microwave cooking mode.
Figure 6:
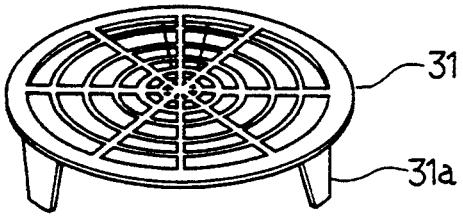
FIG. 6 is a perspective view of a thawing gridiron used in the microwave cooking mode.
Figure 7:
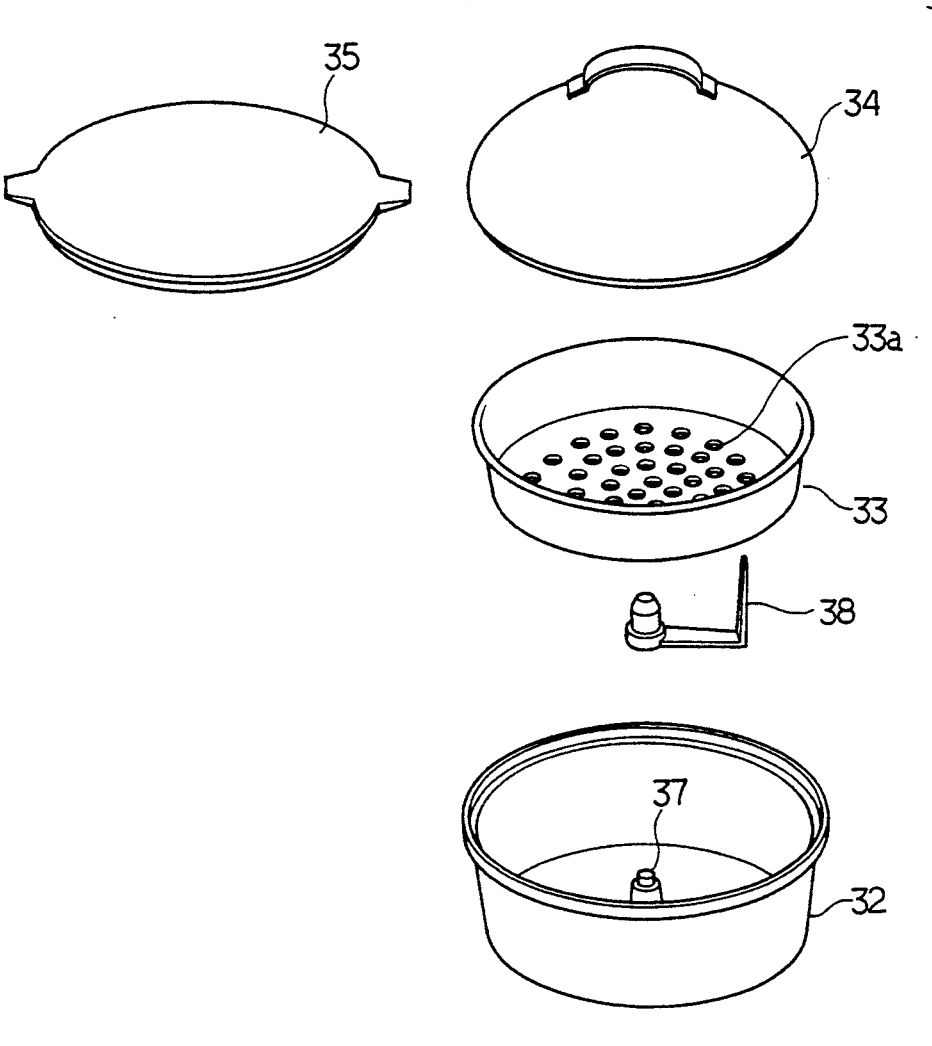
FIG. 7 is a perspective view of a pot, its inner container, metal lid and glass lid.
Figure 13:
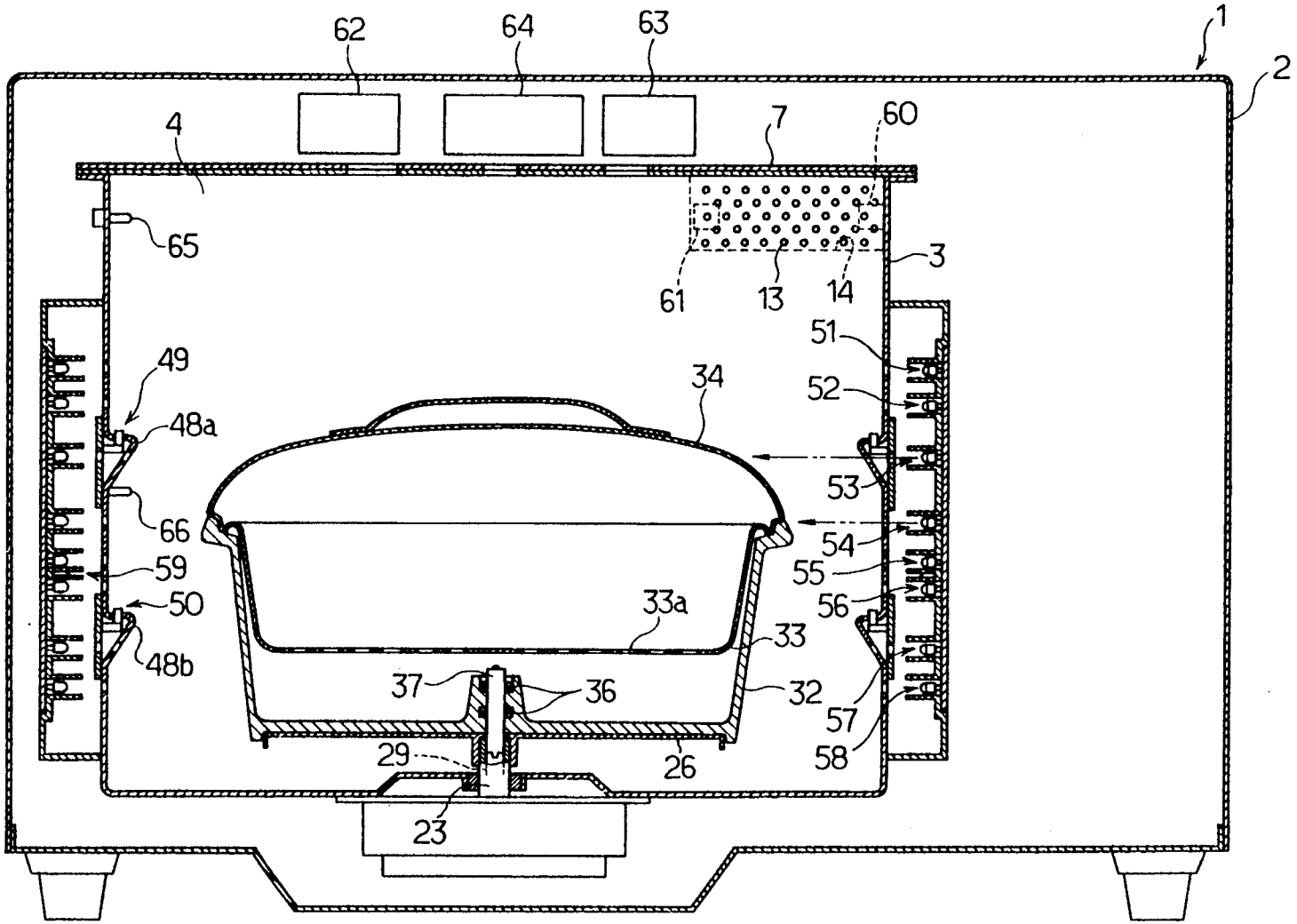
FIG. 13 is a longitudinally sectional front view of the microwave oven, showing the condition of a steaming mode.

The cooking utensils employed for the respective cooking modes will now be described. A glass dish 30 as shown FIG. 5 is employed for the warming mode in the microwave cooking. A thawing gridiron 31 as shown in FIG. 6 is employed for the thawing mode. A glass pot 32 as shown in FIG. 7 is employed for the pot-used cooking mode. In the warming mode, the glass dish 30 is placed on the turntable 26 and the receptacle containing rice or dishes to be heated is placed on the glass dish 30. The thawing gridiron 31 is made of plastics, for example, and has a plurality of legs 31*a* formed on its circumference. In the thawing mode, the thawing gridiron 31 is placed on the glass dish 30 further placed on the turntable 26. The frozen meat or "sashimi" is then placed on the thawing gridiron 31. In the case of the pot-used cooking mode, the pot 32 is placed on the turntable 26. The pot 32 includes a inner metal receptacle 33 enclosed in the pot 32 and two kinds of lids covering the top of the pot 32, that is, a metal lid 34 and a glass lid 35. A bearing 36 is mounted on the central bottom of the pot 32 as is shown in FIG. 13. An agitating shaft 37 is mounted on the bearing 36. An agitating blade 38 serving as an agitator is detachably attached to the agitating shaft 37.

The pot-used cooking mode includes a steaming mode, a stewing mode and a boiling mode in which rice or dishes are boiled. In the steaming mode, a predetermined amount of water is put into the pot 32, in which the bottom of the inner receptacle 33 is positioned above the water surface as shown in FIG. 13. Food is put into the inner receptacle 33 and then, the metal lid is put onto the top of the pot 32. The pot 32 is then placed directly (or through the glass dish 30) on the turntable 26. Upon energization of the magnetron 5, the water in the inner receptacle 33 is heated by the microwaves. The water is boiled and steam is generated. The steam is fed into the inner receptacle 33 through a number of small apertures 33*a* formed in the bottom of the inner receptacle 32, thereby steaming the food. In this case, the food is not directly heated by the microwaves since the food is contained in the inner metal receptacle 32 and the metal lid 34 is put on the top.

Figure 12:
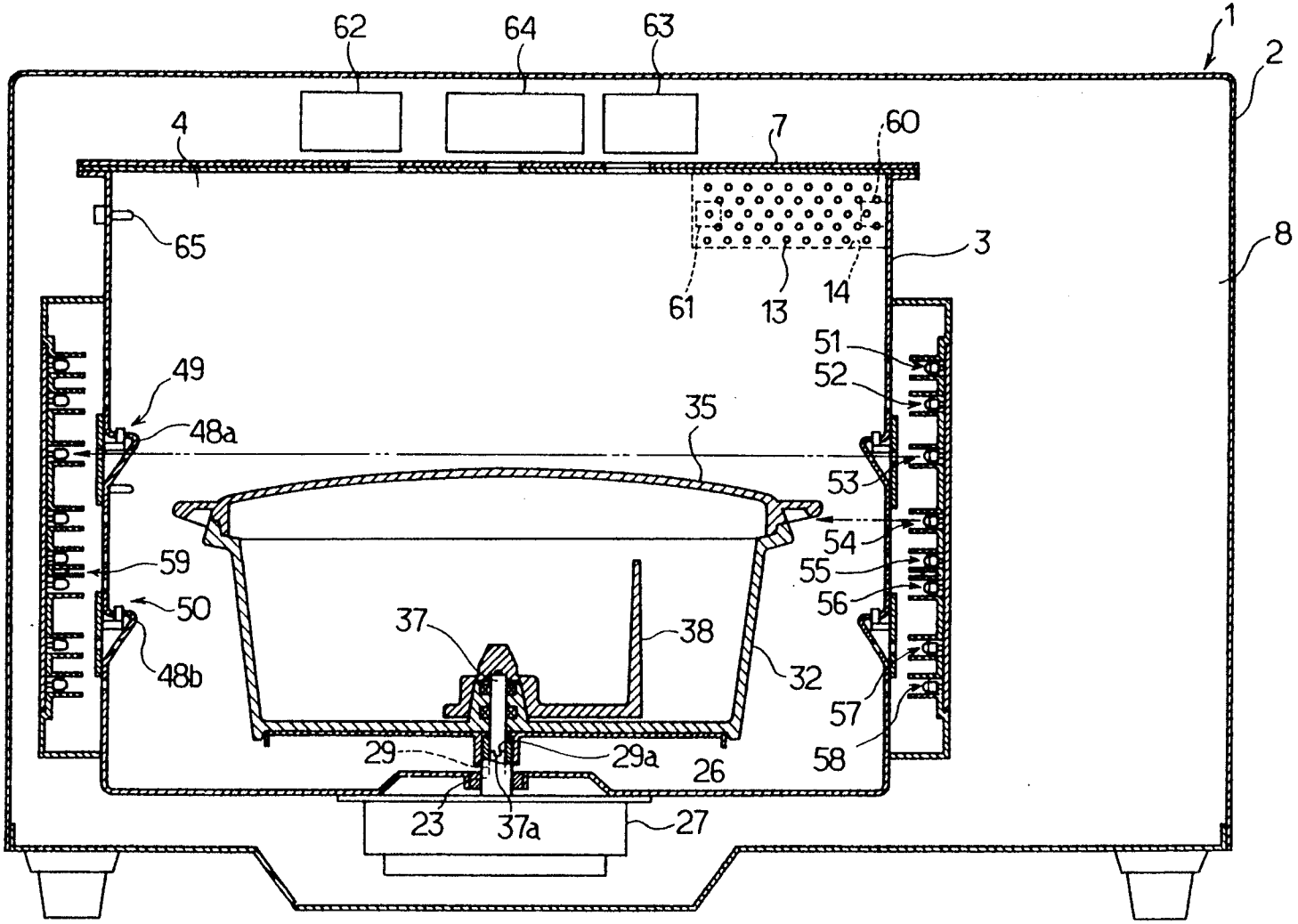
FIG. 12 is a longitudinally sectional front view of the microwave oven, showing the condition of a stewing mode.

In each of the stewing and boiling modes, foodstuffs are contained in the pot 32, which is then covered by the glass lid 35. In the stewing mode, the inner receptacle 33 is not used and the agitating blade 38 is attached to the agitating shaft 37, as is shown in FIG. 12, since the foodstuffs need to be agitated during the heating. When the pot 32 is placed on the turntable 26, an engagement protrusion 37*a* formed on the lower end of the agitating shaft 37 is engaged with an engagement concave portion 29*a* formed on the upper end of the stationary shaft 29 such that the agitating shaft 37 is coupled to the stationary shaft 29. Accordingly, when the agitating blade 38 is attached to the agitating shaft 37, the pot 32 is turned upon turn of the turntable 26 so that the foodstuffs contained in the pot 32 are agitated by the agitating blade 38 which is moved with respect to the pot.

As described above, various kinds of cooking utensils are placed on the turntable 26. A weight sensor 39 is provided for detecting the weight of the food contained in the cooking utensil. A torque sensor 40 is provided for serving as agitator detecting means for detecting presence or absence of the agitating blade 38 provided in the pot 32 in the pot-used cooking mode, as shown in FIG. 3. The weight sensor 39 comprises a movable electrode plate 41 formed of a leaf spring, a fixed electrode plate (not shown) formed on the upper face of a printed board 42. The movable electrode plate 41 and the printed board 42 are mounted on the support member 27 to be vertically opposite to each other so that a capacitor is composed of the movable electrode plate 41 and the fixed electrode plate. An oscillation circuit serving as a sensor circuit is provided on the printed board 42. The oscillation circuit is designed to oscillate at a frequency in accordance with an electrostatic capacity between the movable electrode plate 41 and the fixed electrode plate.

The above-described weight sensor 39 detects the weighting applied to the rotating shaft 23. For this purpose, the rotating shaft 23 is vertically movable and rotatably mounted on the movable electrode 41. Accordingly, the movable electrode plate 41 receives the weighting applied to the rotating shaft 23 such that the movable electrode plate 41 is deflected downwards an amount in accordance with the received weighting. Consequently, the distance between the movable electrode plate 41 and the fixed electrode plate is varied. Upon variation in the interelectrode distance, the frequency at which the oscillation circuit oscillates is detected, whereby the weighting applied to the rotating shaft 23 is detected.

Figure 4:
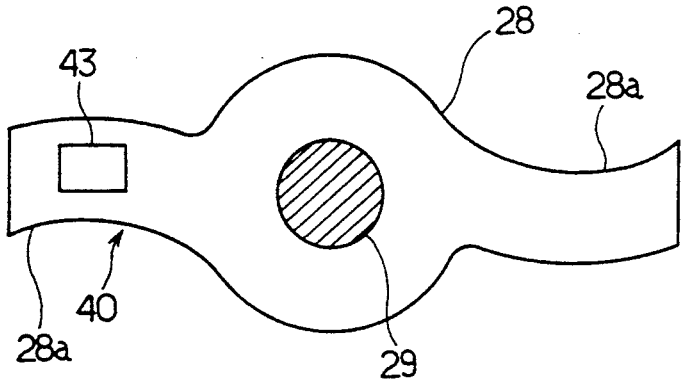
FIG. 4 is an enlarged plan view of a torque sensor employed in the microwave oven.

The torque sensor 40 comprises a strain gauge 43 attached to the mounting plate 28 as shown in FIG. 4.

The mounting plate 28 has two arc-shaped arms 28*a* respectively projecting from both sides of a circular portion to which the stationary shaft 29 is fixed. Distal ends of the arc-shaped arms 28*a* are secured to a pair of support pieces 27 respectively. The strain gauge 43 is attached to one of the arc-shaped arms 28*a*. The resistance of the food against agitation is applied to the agitating blade 38 upon turn of the turntable 26 when the agitating blade 38 is attached to the agitating shaft 37 of the pot 32 placed on the turntable 26. Consequently, a torque acts on the stationary shaft 29. Since the torque acting on the stationary shaft 29 causes the arms 28*a* of the mounting plate 28 to be twisted, the strain gauge 43 is accordingly distorted such that its electrical resistance is varied. The electrical resistance of the strain gauge 43 is detected by the sensor circuit (not shown), which generates a voltage signal. Thus, the presence or absence of the agitating blade 38 can be detected on the basis of the magnitude of the electrical signal from the torque sensor 40.

Figure 8:
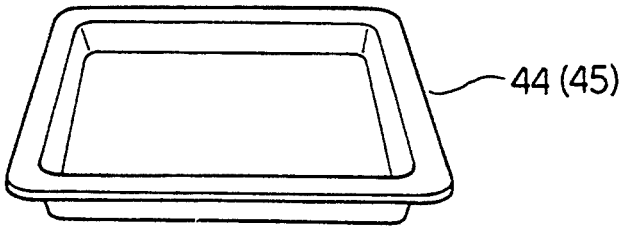
FIG. 8 is a perspective view of a top plate used in the oven mode.
Figure 9:
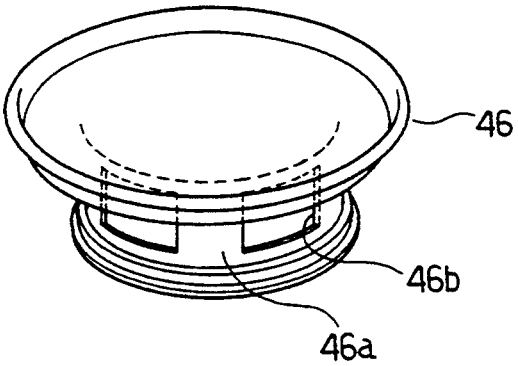
FIG. 9 is a perspective view of a rotative top plate used in the oven mode.
Figure 10:
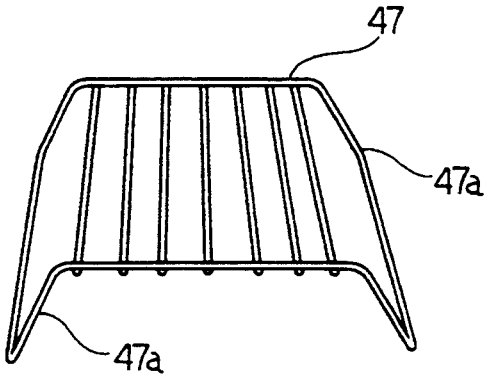
FIG. 10 is a perspective view of a gridiron used in the oven and grill modes.

The microwave oven is provided, for the oven and grill modes, with two metal top plates 44 and 45 as shown in FIG. 8 in which only one of them is shown, a one-legged metal top plate 46 as shown in FIG. 9, and a heater cooking gridiron or food holder 47 formed of metal wires as shown in FIG. 10. The top plates 44, 45 are identical with each other and formed into the shape of a shallow square dish. Each of the top plates 44, 45 is held on the wall surface of the heating chamber 4. For this purpose, upper top plate holders 48*a* and lower top plate holders 48*b* each comprising concave pieces extending longitudinally are provided on the right- and left-hand walls of the heating chamber 4 in two stages, as shown in FIG. 1. Since the top plates 44, 45 are identical with each other, they can be held on either of the upper and lower top plate holders 48*a*, 48*b*. In the embodiment, however, the top plate 44 is exclusively held on the upper top plate holders 48*a* and the top plate 45 is exclusively held on the lower top plate holders 48*b*.

The rotative top plate 46 is formed into the shape of a shallow round dish and has a cylindrical leg 46*a* having a plurality of apertures 46*b*. The rotative top plate 46 is placed on the turntable 26 in use. The gridiron 47 has two legs on its opposite sides respectively and such dimensions as to be allowed to be placed on the top plates 44, 45.

Both or either one of the top plates 44, 45 is usually used in the oven mode. The rotative top plate 46 or the gridiron 47 is used depending upon the food to be cooked. In use in the oven mode, the gridiron 47 is placed on the lower top plate 45 disposed in the heating chamber 4. In case the gridiron 47 is used in the grill mode, only the upper top plate 44 is used and the gridiron 47 is placed on it so that the food is positioned as close as possible to the grill heater 7.

As described above, the microwave oven of the embodiment is provided with a number of cooking utensils. Various sensors are provided so that the cooking utensil disposed in the heating chamber 4 is detected on the basis of its condition of disposition such as the position or the height.

Turning to FIG. 1, weight sensors 49 and 50 are provided on the upper and lower top plate holders 48*a*, 48*b* for detecting presence or absence of the top plates 44, 45 on the holders and the weight of the food placed on the top plates 44, 45, respectively. These upper and lower weight sensors 49, 50 comprise detecting plates 49*a* and 50*a* mounted on the inner sides of the holders 48*a*, 48*b* and protrusions 49*b* and 50*b* protruding from the detecting plates 49*a*, 50*a* to extend over the upper faces of the holders 48*a*, 48*b*, respectively.

Strain gauges (not shown) are mounted on the detecting plates 49*a*, 50*a* respectively. When the top plates 44, 45 are placed on the respective holders 48*a*, 49*a*, the weight of the top plates 44, 45 acts on the detecting plates 49*a*, 50*a* via the protrusions 49*b*, 50*b*, respectively. The detecting plates or the strain gauges are deflected such that the electrical resistance values are varied. The resistance of each strain gauge is detected by the sensor circuit (not shown), which circuit generates a voltage signal. Consequently, the weight of each top plate can be determined from the voltage signal.

Light-emitting elements 51*a*–58*a* each comprising a light-emitting diode radiating infrared rays, for example, are mounted on the right-hand outside of the inner receptacle 3 so as to be longitudinally aligned at predetermined intervals. Light-receiving elements 51*b*–58*b* each comprising a phototransistor are mounted on the left-hand side of the inner receptacle 3 to be paired with the light-emitting elements respectively. These paired light-emitting elements 51*a*–58*a* and light-receiving elements 51*b*–58*b* compose first to eighth light-transmission type photosensors 51 through 58. A number of small apertures 3*a* and 3*b* are formed in the right- and left-hand side walls of the inner receptacle 3 in order that light emitted from the light-emitting elements 51*a*–58*a* reaches the light-emitting elements 51*b*–58*b* through the heating chamber 4. The photosensors 51–54 and 56–58 compose cooking utensil detecting means for detecting the cooking utensil based on its altitude, except the fifth photosensor 55.

Figure 21:
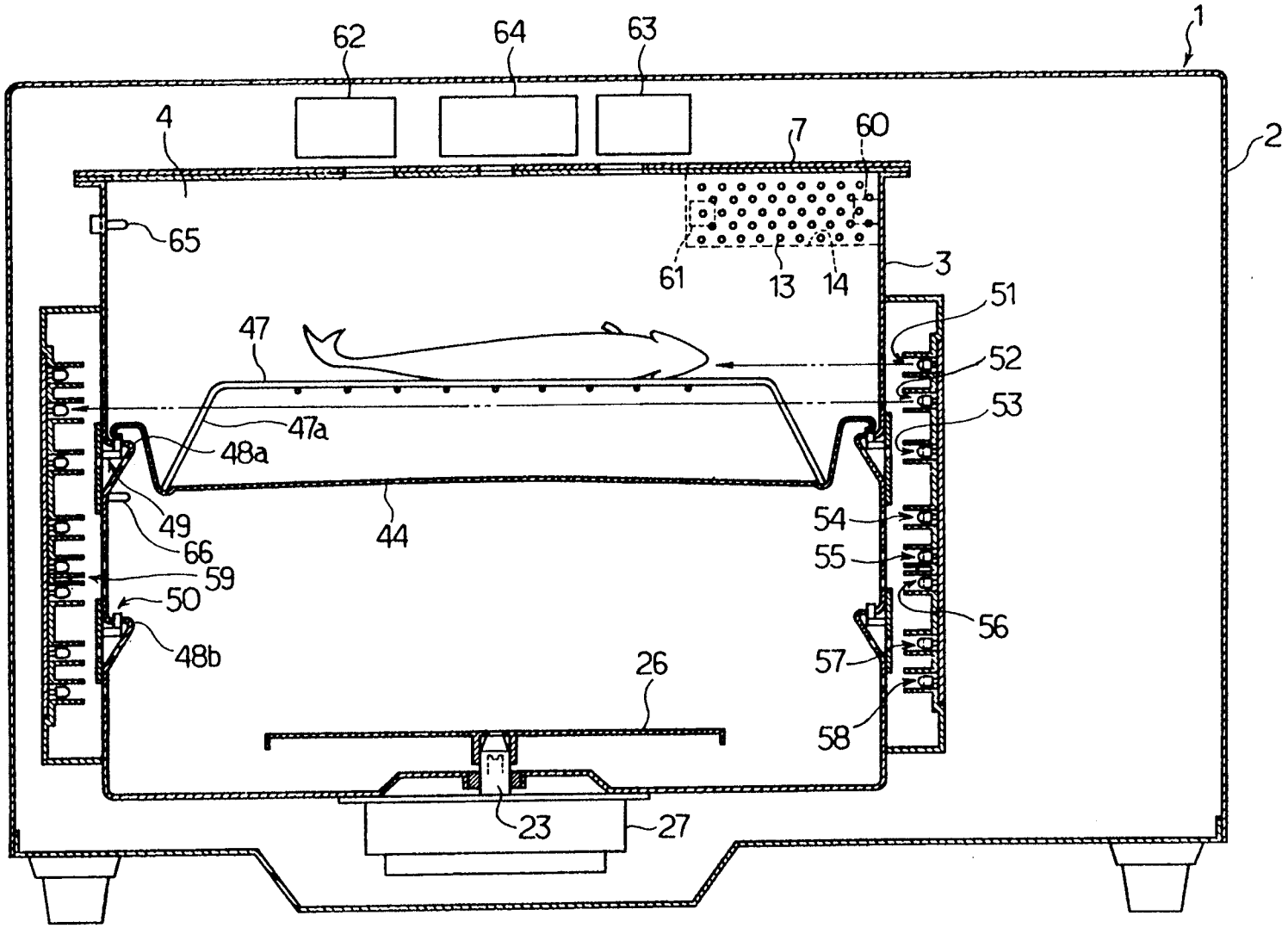
FIG. 21 is a longitudinally sectional front view of the microwave oven, showing the condition of a grill mode.

The upper most first photosensor 51 and the second photosensor 52 serve to detect the gridiron 47 disposed for the grill mode. In execution of the grill mode, the gridiron 47 is placed on the upper top plate 44 held on the upper holders 48*a* as shown in FIG. 21. The food to be cooked is then placed on the gridiron 47. A light path of the uppermost first photosensor 51 is so set as to pass slightly over the gridiron 47 and the light axis of the second photosensor 52 is so set as to pass slightly below the gridiron 47.

When the food is placed on the gridiron 47 on the upper top plate 44, the light path of the first photosensor 51 is intercepted by the food. However, only the second photosensor 52 delivers an on-signal since there is no interceptor in the light path of the second photosensor 52. Further, when not the gridiron 47 but the food having a large height is placed on the upper top plate 44, only the light path of the second photosensor 51 is intercepted by the food or the light paths of both first and second photosensors 51, 52 are intercepted. Accordingly, the presence of the gridiron 47 for the grill mode is detected when the first photosensor 51 is off and the second photosensor 52 is on.

The third photosensor 53 and the fourth photosensor 54 are provided for detecting presence or absence of the pot 32 placed on the turntable 26. When the metal lid 34 is put on the pot 32 placed on the turntable 26, the metal lid 34 is positioned in the light paths of the third and fourth photosensors 53, 54, as is shown in FIG. 13. When the glass lid 35 is put on the pot 32, the glass lid 35, which is lower than the metal lid 34, is in the light path of the fourth photosensor 54 but out of the light path of the third photosensor 53, as is shown in FIG. 12.

Consequently, the presence of the pot 32 can be detected when both of the third and fourth photosensors 53, 54 are off or when the third photosensor 53 is on with the fourth photosensor 54 off. Simultaneously, either the metal lid 34 or the glass lid 35 can be detected depending upon the on- or off-state of the photosensors 53, 54. Accordingly, the third and fourth photosensors 53, 54 also serves as lid detecting means for detecting the kind of the lid.

Figure 24:
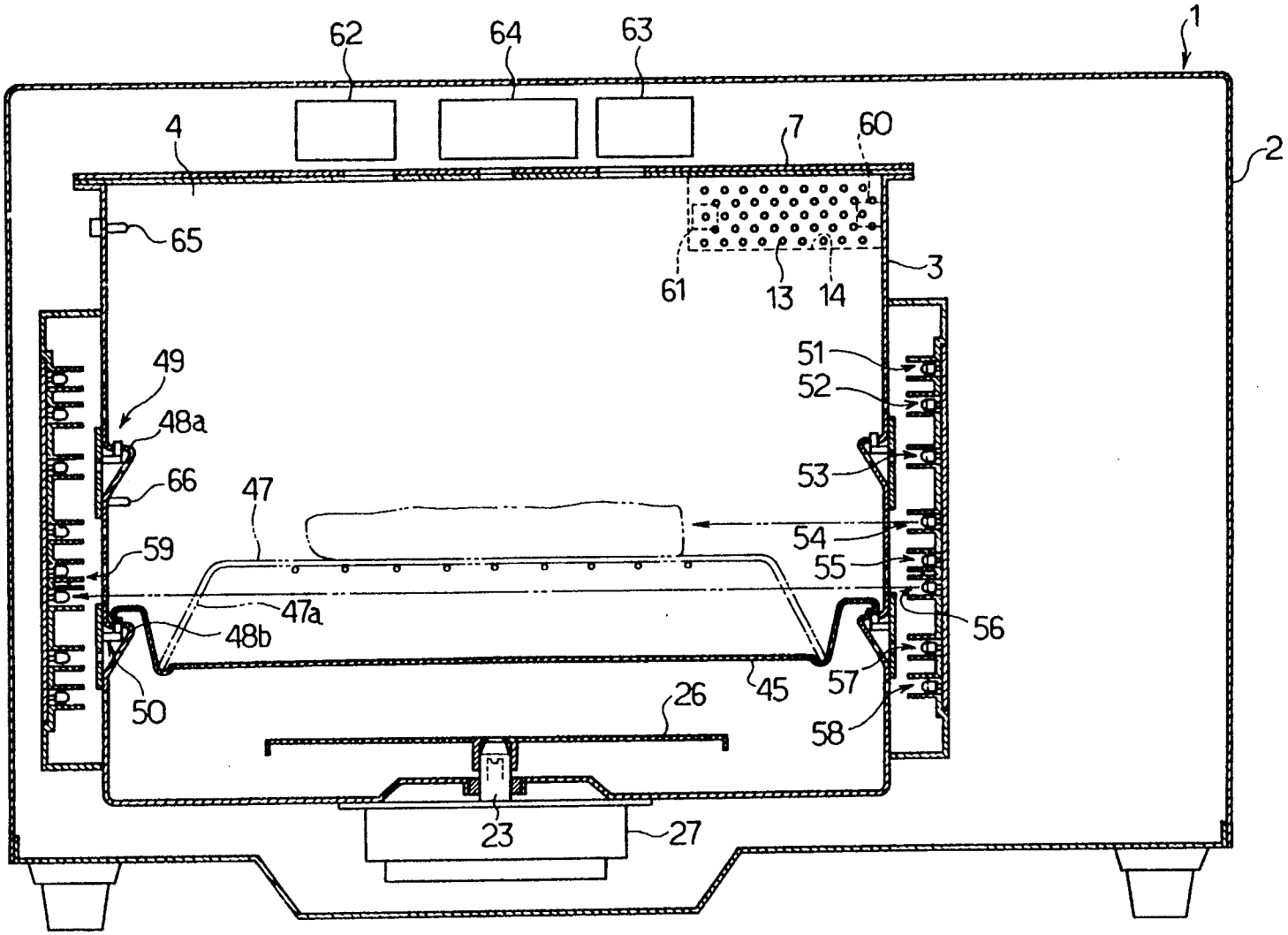
FIG. 24 is a longitudinally sectional front view of the microwave oven, showing the condition of the oven mode in use of the lower top plate.

The fourth and sixth photosensors 54, 56 are provided for detecting presence of the gridiron 47 used in the oven mode. When used in the oven mode, the gridiron 47 is placed on the lower top plate 45 held on the lower holders **48*b*, as is shown in FIG. 24. The food to be cooked is then placed on the gridiron 47. The light path of the fourth sensor 54 is so set as to pass slightly over the gridiron 47 while that of the sixth photosensor 56 is so set as to pass slightly below the gridiron 47. When the food is placed on the gridiron 47 on the lower top plate 45, the light path of the fourth photosensor 54 is intercepted by the food while there is no interceptor in the light path of the sixth photosensor 56. Consequently, only the sixth photosensor 56 is on. Furthermore, when not the gridiron 47 but the food having a large height is placed on the lower top plate 45, only the sixth photosensor 56 is off by the food or both fourth and sixth photosensors 54, 56 are off. Consequently, presence of the gridiron 47 used for the oven mode can be detected when the fourth photosensor 54 is off with the sixth photosensor 56** on.

Figure 20:
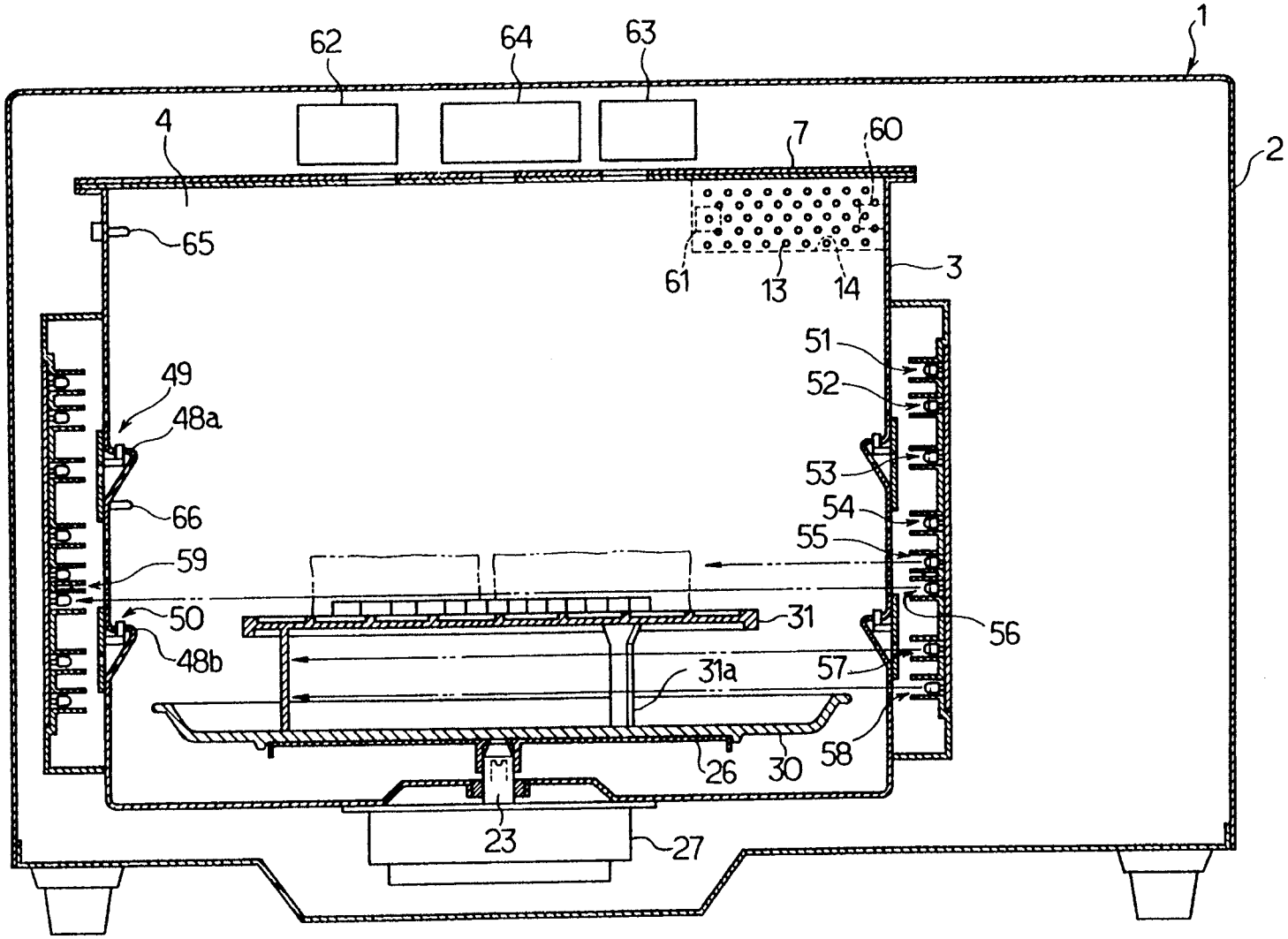
FIG. 20 is a longitudinally sectional front view of the microwave oven, showing the condition of a thawing mode.
Figure 25:
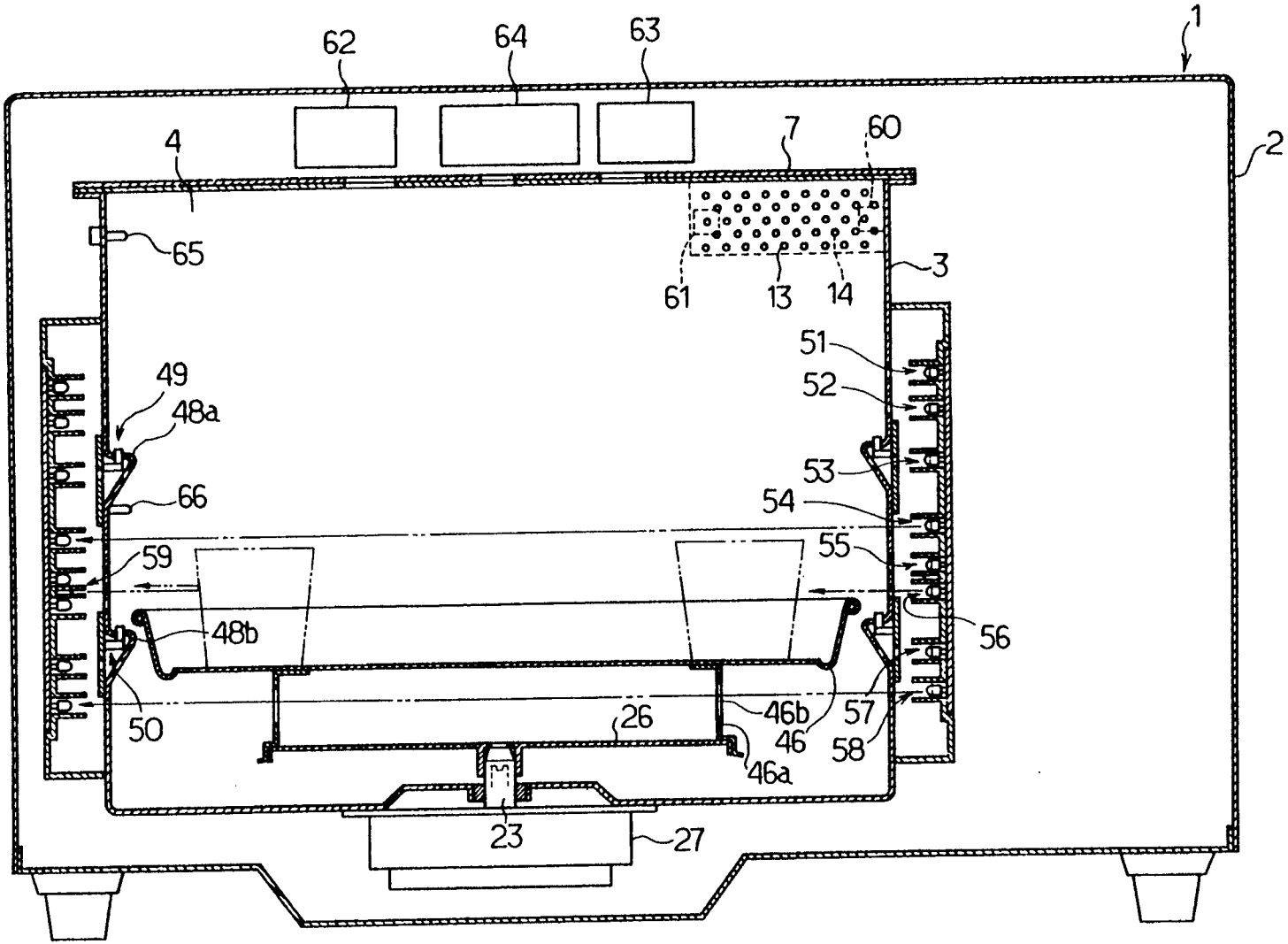
FIG. 25 is a longitudinally sectional front view of the microwave oven, showing the condition of the oven mode in use of the rotative top plate.

The seventh and eighth photosensors 57, 58 are provided for determining which of the thawing gridiron 31 and the rotative top plate 46 is placed on the turntable 26. When the thawing gridiron 31 is placed on the glass dish 30 on the turntable 26 as shown in FIG. 20, one of the legs **31*a* of the thawing gridiron 31 can be in the light paths of the seventh and eighth photosensors 57, 58. Furthermore, when the rotative top plate 46 is placed on the turntable 26 as shown in FIG. 25, its portion having no apertures 46*b* is in the light path of the seventh photosensor 57 and its portion having the apertures 46*b* can be in the light path of the eighth photosensor 58. Accordingly, when the turntable 26 is turned one turn or above, the legs 31*a* of the thawing gridiron 31 intermittently pass the light paths of the seventh and eighth photosensors 57, 58, thereby repeatedly turning on and off alternately. In the case of the rotative top plate 46, the seventh photosensor 57 is usually in the off-state while the eighth photosensor 58 repeatedly turns on and off alternately since the apertures 46*a* intermittently pass the light path of the eighth photosensor 58. Consequently, presence of the thawing gridiron 31 can be detected when both the seventh and eighth photosensors 57, 58 repeatedly turns on and off alternately. Presence of the rotative top plate 46 can be detected when the eighth photosensor 58 repeatedly turns on and off alternately with the seventh photosensor 57 off. Consequently, both photosensors 57, 58 determine the cooking utensils 31, 46 based on its configuration On the other hand, the microwave oven is provided with various sensors for classifying the food contained in the cooking utensil. These sensors include a thickness sensor for detecting the thickness of the food such as frozen raw food placed on the thawing gridiron 31 so that the food is classified. The thickness sensor comprises the fifth and sixth photosensors 55 and 56. More specifically, the light path of the fifth photosensor 55 is set to pass 2 centimeters above the upper face of the thawing gridiron 31 on the glass dish 30, as is shown in FIG. 20. The light path of the sixth photosensor 56 is set to pass one centimeter above the upper face of the thawing gridiron 31 on the glass dish 30. A search made by the inventors shows that commercially sold meat generally has the thickness of 2 centimeters or above and commercially sold "sashimi" generally has the thickness of one centimeter or below. Then, the frozen raw food is classified into the meat when both photosensors 55, 56 are off while it is classified into "sashimi" when both photosensors 55, 56** are on.

Figure 23:
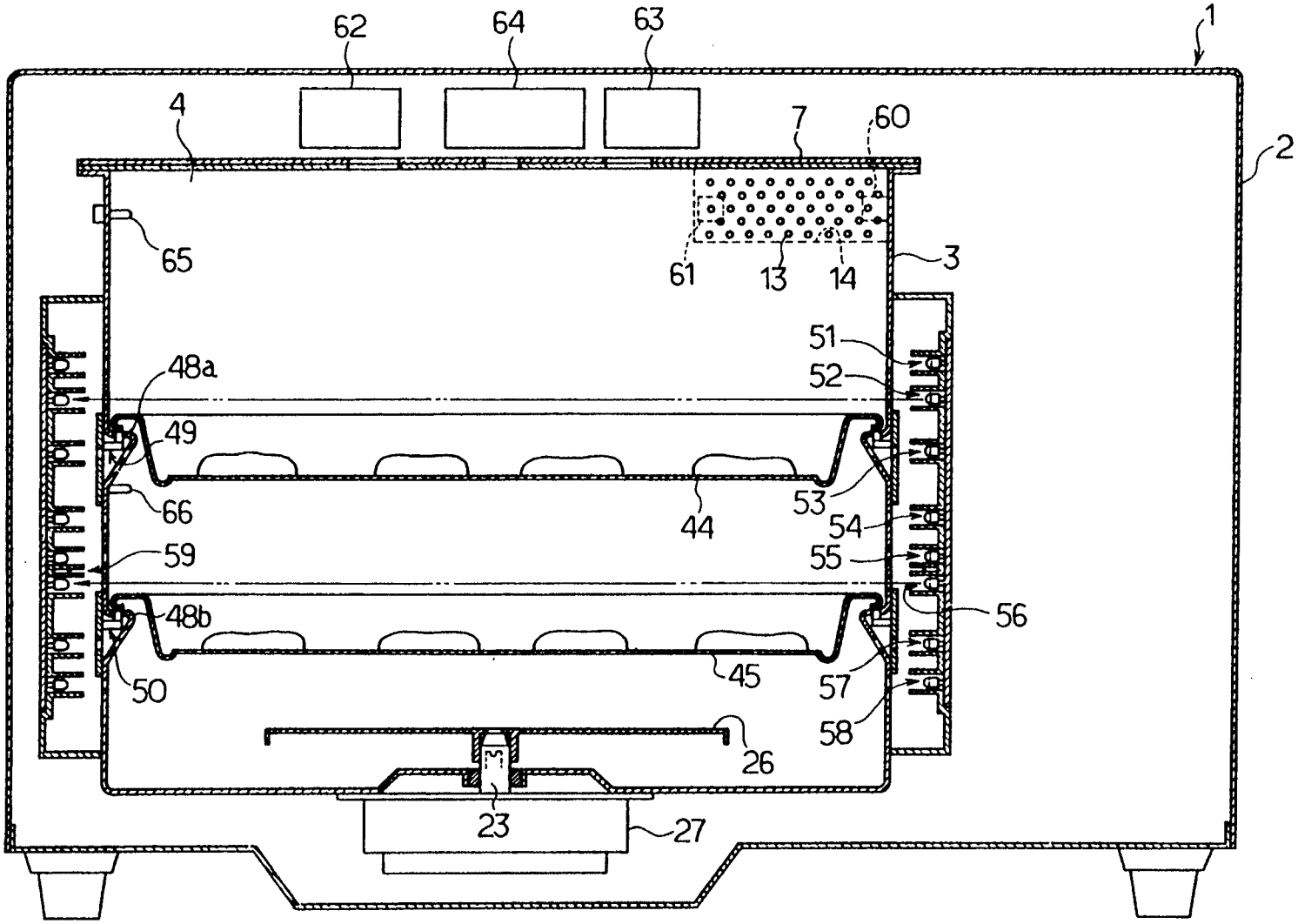
FIG. 23 is a longitudinally sectional front view of the microwave oven, showing the condition of an oven mode in use of the upper and lower top plates.

Furthermore, a height sensor is provided for detecting the height of the food so that the food placed on the cooking utensil is classified. The height sensor comprises the second, fourth and sixth photosensors 52, 54 and 56. The second photosensor 52 detects the height of the food placed on the upper top plate 44. The light path of the second photosensor 52 is set to pass slightly above the upper face of the upper top plate 44, as is shown in FIG. 23. The fourth and sixth photosensors 54, 56 detect the height of the food placed on the lower top plate 45 and the rotative top plate 46. The light path of the sixth photosensor 56 is set to pass slightly above the upper faces of the lower top plate 45 and the rotative top plate 46 as shown in FIGS. 24 and 25. The light path of the fourth photosensor 54 is higher than that of the sixth photosensor 56. Additionally, the fourth photosensor 54 is utilized to detect the height of the receptacle placed on the glass dish 30.

Figure 26:
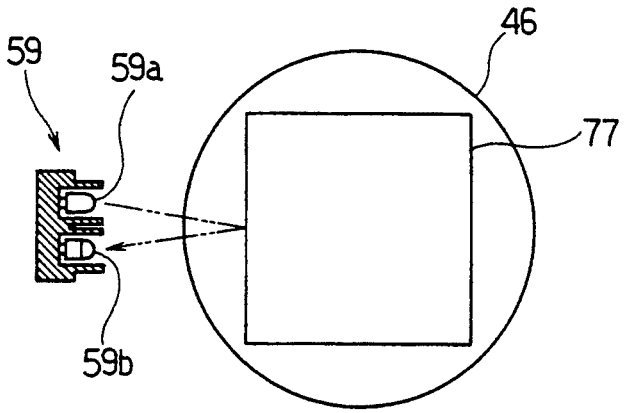
FIGS. 26(*a*) and 26(*b*) are plan views of the rotative top plate and a number sensor.
Figure 26:
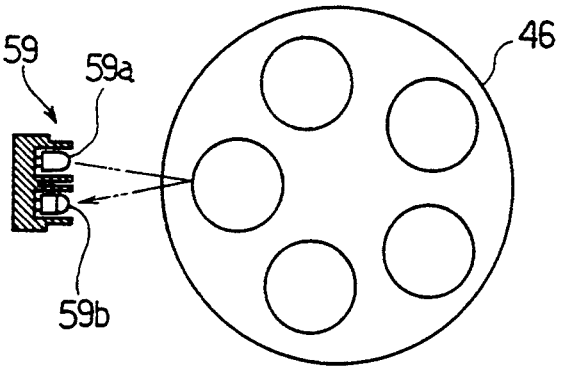

A reflection type photosensor 59 is provided at the left-hand side of the inner casing 3 for serving as a number sensor detecting the number of pieces of food so that the food placed on the rotative top plate 46 is classified. The photosensor 59 comprises a light-emitting element **59*a* comprising a light-emitting diode radiating infrared rays and a light-receiving element 59*b* comprising a phototransistor, for example, as shown in FIG. 26. The photosensor 59 is disposed between the light-receiving elements 55*b*, 56*b* of the fifth and sixth photosensors 55, 56. The photosensor 59 detects the number of pieces of food from the number of times at which the light-receiving elements 59*b* receives the reflected light. The photosensor 59 is designed to vary the magnitude of its output signal in accordance with the luminous intensity of the received light and to determine the form of the food from the magnitude of the output signal. A plurality of small apertures (not shown) are formed in the left-hand side wall of the inner casing 3 so that the light from each light-emitting element 59*a* is radiated into the heating chamber 4 to be reflected to reach each corresponding light-receiving element 59*b***.

Other sensors for food classification include an alcohol sensor 60, a humidity sensor 61, a CCD camera 62 serving as both photographing means and number sensor, and a color sensor 63. The alcohol sensor 60 and the humidity sensor 61 are disposed in the vicinity of the outlet 13 of the exhaust duct 14, as is shown in FIG. 1 and detect alcohol and humidity in the heating chamber 4 respectively. The CCD camera 62 and the color sensor 63 are disposed over the inner casing 3 in the outer casing 1 and are arranged so that the interior of the heating chamber 4 comes within its field via apertures **3*c* and 3*d* formed in the top of the inner casing 3. A pilot lamp (not shown) illuminating the interior of the heating chamber 4 serves as a light source for the CCD camera 62 and the color sensor 63** during the cooking operation.

An infrared sensor 64 is also disposed over the inner casing 3 in the outer casing 1 for detecting the temperature of the food. The infrared sensor 64 detects the infrared rays from the food through an aperture 3*e* formed in the top of the inner casing 3. Furthermore, temperature sensors 65 and 66 are provided for sensing the atmospheric temperature in the heating chamber 4 during the oven mode and the grill mode respectively. The temperature sensor 65 for the oven mode senses the atmospheric temperature in the upper interior of the heating chamber 4 and the temperature sensor 65 for the grill mode senses the atmospheric temperature in the vicinity of the underside of the upper top plate 44.

Figure 11:
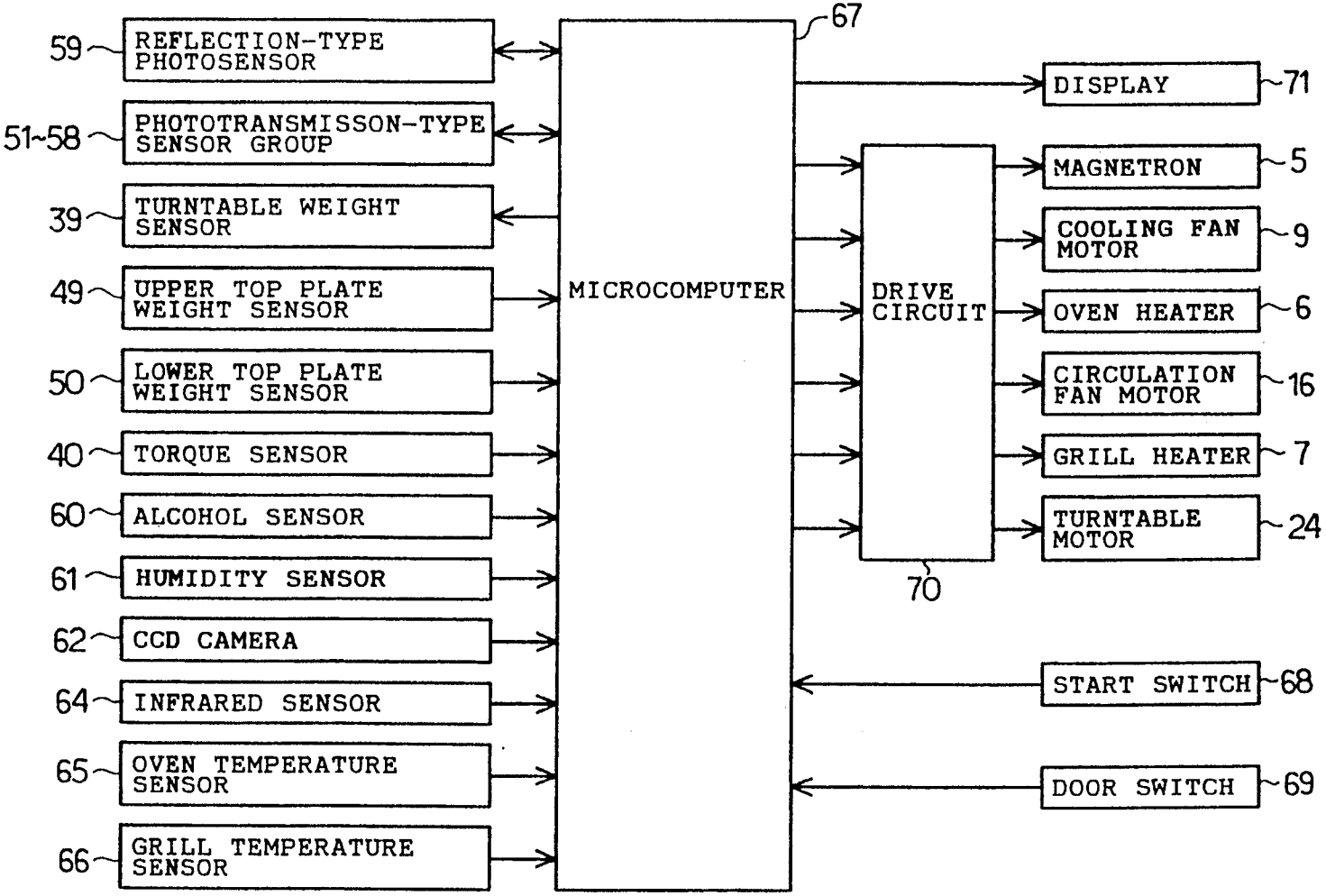
FIG. 11 is a block diagram showing an electrical arrangement of the microwave oven.

FIG. 11 shows an electrical circuit arrangement of the microwave oven. As shown, the light-emitting elements 51*a*–59*a* of the photosensors 51–59 respectively are controlled by a microcomputer 67 serving as control means. Detection signals generated by the light-receiving elements 51*b*–59*b* of the photosensors 51–59 respectively are supplied to the microcomputer 67. Furthermore, the microcomputer 67 is supplied with detection signals generated by the weight sensors 39,49 and 50, the torque sensor 40, the alcohol sensor 60, the humidity sensor 61, the CCD camera 62, the infrared sensor 64, and the temperature sensors 65, 66. Additionally, the microcomputer 67 is supplied with a signal generated by a start switch provided on the operation panel 20 and a signal generated by a door switch 69 turned on and off when the door 19 is opened and closed. The microcomputer 67 is provided with an A/D conversion circuit converting an externally input digital signal to an analog signal. Based on the input signals from the various sensors and a predetermined control program, the microcomputer 67 controls the magnetron 5, the heaters 6, 7, the fan motors 9, 16 and the drive motor 24 driving the turntable 26 via a drive circuit 70.

The operation of the microwave oven thus constructed will now be described. In the embodiment, the food to be cooked is classified and the heating operation is controlled on the basis of a cooking menu program in accordance with the classification of the food finally. For the purpose of food classification, the microcomputer 67 first determines a cooking mode (the kind of the heating modes) from the cooking utensil placed in the heating chamber 4. Subsequently, the classification of the food is performed on the basis of the detection signals from the various sensors. Then, the microcomputer 67 controls the heating operation in accordance with the food contained in the heating chamber 4. Accordingly, the microcomputer 67 also serves as cooking mode selecting means. The name of the cooking mode selected by the microcomputer 67 is displayed on a display 71 (see FIG. 11) provided in the operation panel 20.

The cooking modes are roughly classified into a microwave cooking mode and a heater cooking mode, as easily understood from the foregoing description. The heater cooking mode is further classified into an oven mode and a grill mode. The microwave cooking mode is further classified into a warming mode, a pot-used cooking mode and a thawing mode depending upon the used cooking utensils. The oven mode is further classified into a cooking mode in which the upper top plate is used, a cooking mode in which the lower top plate is used, a cooking mode in which both the upper and lower top plates are used, and a cooking mode in which the rotative top plate is used, depending upon the used cooking utensils.

The following TABLE 1 shows the above-described cooking modes and the cooking utensils used in the respective cooking modes.

TABLE 1

| COOKING MODE | USED COOKING UTENSIL |
|---|---|
| MICROWAVE COOKING MODE | |
| WARMING | GLASS DISH |
| POT-USED COOKING | POT |
| THAWING | THAWING GRIDIRON |
| HEATER COOKING MODE | |
| OVEN MODE | |
| UPPER TOP PLATE USE MODE | UPPER TOP PLATE |
| LOWER TOP PLATE USE MODE | LOWER TOP PLATE (GRIDIRON SOMETIMES PLACED ON LOWER TOP PLATE) |
| UPPER AND LOWER TOP PLATES USE MODE | UPPER AND LOWER TOP PLATES |
| GRILL MODE | UPPER TOP PLATE GRIDIRON |

Figure 27:
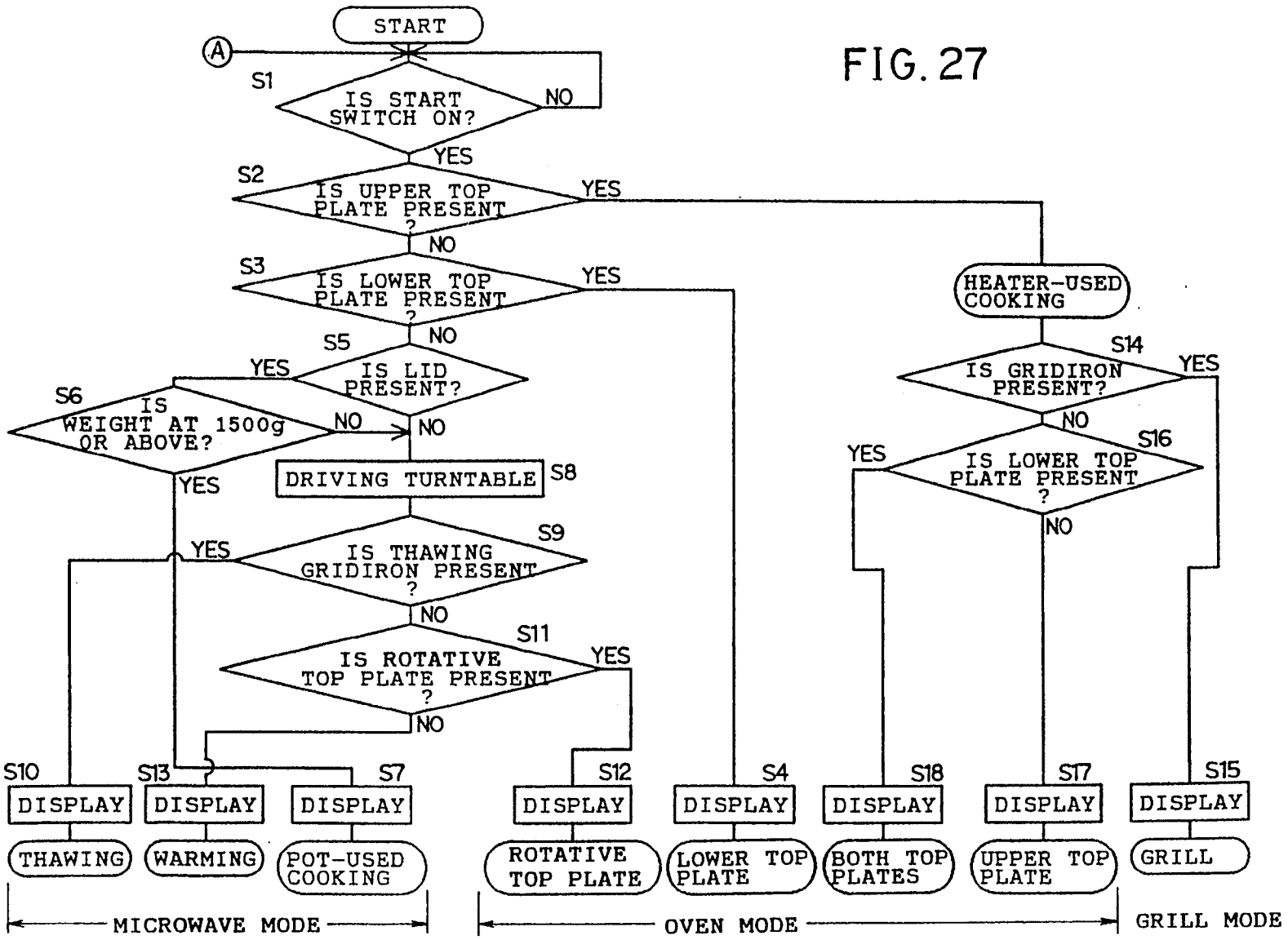
FIG. 27 is a flowchart showing the operation for selecting a cooking mode.

When the microwave oven is plugged in to a power supply plug receptacle, the microcomputer 67 is initialized and monitors the start switch 68 (step S1 in FIG. 27).

In execution of the heating, the user puts the food to be cooked into a suitable cooking utensil in accordance with the contents of the cooking. Then, the cooking utensil containing the food is placed in the heating chamber 4 and the start switch 68 is operated. Upon operation of the start switch 68, the microcomputer 67 executes the cooking mode selecting program for determining the cooking utensil placed in the heating chamber 4 and selecting the cooking mode.

The contents of the cooking mode selecting program will be described for every cooking utensil with reference to the flowchart of FIG. 27.

Detection of the Upper Top Plate 44

Upon operation of the start switch 68, the microcomputer 67 advances to step S2 where it is determined whether the upper top plate 44 is present or not. This determination is based on the weight detected by the upper weight sensor 49. That is, since the single upper top plate weighs about one kilogram (same as the lower top plate 45), the net weight of the upper top plate 44 containing the food exceeds the value of one kilogram. The microcomputer 67 determines that the upper top plate 44 is present, when the weight detected by the upper weight sensor 49 exceeds the value of one kilogram. The microcomputer 67 determines that the upper top plate 44 is absent, when the weight detected by the upper weight sensor 49 is one kilogram or below.

Detection of the Lower Top Plate 45

The microcomputer 67 advances to step S3 when determining at step S2 that the upper top plate 44 is absent. In step S3, the microcomputer 67 determines whether the lower top plate 45 is present or not. This determination is based on the weight detected by the lower weight sensor 50. In the same manner as in step S2, the microcomputer 67 determines that the lower top plate 45 is present, when the weight detected by the lower weight sensor 50 exceeds the value of one kilogram. The microcomputer 67 determines that the lower top plate 45 is absent, when the weight detected by the lower weight sensor 50 is one kilogram or below.

The thawing gridiron 31, the pot 32, the rotative top plate 46 or the like cannot be placed on the turntable 26 when the lower top plate 45 has been placed on it. When it is determined at step S3 that the lower top plate 45 is present, the cooking mode to be selected is a mode in which only the lower top plate is used is necessarily set. Since this cooking mode belongs to the oven mode with use of the lower top plate 45. Consequently, the microcomputer 67 selects this cooking mode, advancing to step S4 where an indication is displayed on the display 71 for execution of the oven mode with use of the lower top plate.

Detection of the Pot 32

When determining at step S3 that the lower top plate 45 is absent, the microcomputer 67 advances to step S5 where it determines whether the pot 32 is present or not on the basis of the presence or absence of the lid. The detection of the presence or absence of the lid is based on the detection signals generated by the third and fourth photosensors 53 and 54 respectively.

When the pot 32 is placed on the turntable 26, either the metal lid 34 or the glass lid 35 is put on the pot 32. As shown in FIG. 13, the optical paths of the third and fourth photosensors 53, 54 are blocked when the metal lid 34 is put on the pot 32, while only the optical path of the fourth photosensor 54 is blocked when the glass lid 35 is put on the pot 32, as shown in FIG. 12. Then, the microcomputer 67 determines that the pot 32 is present when both of the third and fourth photosensors 53, 54 are turned off or when only the fourth photosensor 54 is turned off. Otherwise, it is determined that the pot 32 is absent.

When determining at step S5 that the lid is present, the microcomputer 67 advances to step S6 where it is determined whether the weight detected by the weight sensor 39 takes a predetermined value or above or not. The optical paths of the third and fourth photosensors 53, 54 are blocked by something other than the lid, for example, by a food placed on the rotative top plate 46 and having a sufficient height. Accordingly, an erroneous determination can be made when it is based only on on-off operation of the photosensors 53, 54. The operation of step S6 is provided for preventing such an erroneous determination. More specifically, the pot 32 is made of glass and weighs about 1.5 kilogram and the net weight of the pot 32 containing the food to be cooked exceeds that value. On the other hand, meat loaf is one of the foods cooked by the use of the rotative top plate 45 and weighing most. The size of the meat loaf is restricted by the height of the heating chamber 4 and the like. Accordingly, such a large meat loaf as weighing 1.5 kilogram or above cannot be cooked. The microcomputer 67 determines that the pot 32 is present, when the weight detected by the weight sensor 39 exceeds the value of 1.5 kilogram, selecting the pot used cooking mode from the microwave cooking mode. Then, the microcomputer 67 advances to step S7 where an indication is displayed on the display 71 for execution of the pot-used cooking mode.

Detection of the Thawing Gridiron 31

The microcomputer 67 advances to step S8 when determining at step S5 that the lid is absent or when determining at step S6 that the weight detected by the weight sensor 39 is 1.5 kilogram or below. In step S8, the motor 24 is started so that the turntable 26 is rotated. The microcomputer 67 then advances to step S9 where it determines whether the thawing gridiron 31 is present or not. This determination is based on the detection signals generated by the seventh and eighth photosensors 57 and 58 respectively. That is, as shown in FIG. 20, when the thawing gridiron 31 is placed on the glass dish 30 which is in turn placed on the turntable 26, the optical paths of the photosensors 57, 58 are intermittently blocked by the legs 31*a* of the thawing gridiron 31 in rotation. On the other hand, when the rotative top plate 46 is placed on the turntable 26 as shown in FIG. 25, the optical path of the seventh photosensor 57 is continuously blocked and only the optical path of the eighth photosensor 58 is intermittently blocked by the cylindrical leg 46*a* with an aperture 46*b*. Accordingly, when both photosensors 57, 58 are intermittently turned on, the microcomputer 67 determines at step S9 that the thawing gridiron 31 is present, selecting the thawing mode from the microwave cooking mode. The microcomputer 67 then advances to step S10 where an indication is displayed on the display 71 for execution of the thawing.

Detection of the Rotative Top Plate 46 and the Glass Dish 30

The microcomputer 67 advances to step S11 when determining at step S9 that the thawing gridiron 31 is absent. At step S11, the microcomputer 67 determines the presence or absence of the rotative top plate 46. This determination is based on the detection signals generated by the seventh and eighth photosensors 57, 58 respectively in the same manner as in the determination about the thawing gridiron 31. The microcomputer 67 determines that the rotative top plate 46 is present when the seventh photosensor 57 is continuously turned off and the eighth photosensor 58 is intermittently turned on. Since the rotative top plate 46 is used only in the oven mode, the microcomputer 67 selects the oven mode in use of the rotative top plate 46. The microcomputer 67 then advances to step S12 where an indication is displayed on the display 71 for execution of the oven mode by use of the rotative top plate.

On the other hand, the microcomputer 67 determines that the rotative top plate 46 is absent, in the case other than where the seventh photosensor 57 is continuously turned off and the eighth photosensor 58 is intermittently turned on. In this case, since it is determined that the upper and lower top plates 44, 45, the pot 32 and the thawing gridiron 31 are absent in the respective previous steps and it is determined at step S11 that the rotative top plate 46 is absent, only the glass dish 30 is left as the cooking utensil. The gridiron 47 is always used with the upper and lower top plates 44, 45. Then, when determining at step S11 that the thawing gridiron 31 is absent, the microcomputer 67 determines that the glass dish 30 is present, advancing to step S13 where an indication for execution of the warming mode is displayed on the display 71. Additionally, after determining in the negative at step S11, the microcomputer 67 may detect the weight on the basis of the weight detected by the weight sensor 39. When the detected weight is only that of the turntable 26, an alarming indication for the absence of the glass dish 30 or any cooking utensil may be displayed on the display 71.

Detection of the Gridiron 47 in the Heater Cooking Mode in Use of the Upper Top Plate 44

The microcomputer 67 executes the cooking program of the heater used cooking mode when determining at step S2 that the upper top plate 44 is present. In this cooking program, the determination is made at step S14 about the presence or absence of the gridiron 47. This determination is based on the output signals of the first and second photosensors 51 and 52.

When the food is placed on the gridiron 47 which is in turn placed on the upper top plate 44 as shown in FIG. 21, the optical path of the first photosensor 51 is blocked by the food on the gridiron 47 while there is nothing to block the optical path of the second photosensor 52. Accordingly, the microcomputer 67 determines that the gridiron 47 is present on the upper top plate 44 when the first photosensor 51 is on and the second photosensor 52 is off, thereby selecting the grill mode. The microcomputer 67 then advances to step S15 where an indication for the grill cooking is displayed on the display 71.

Detection of the Lower Top Plate 45 in the Heater Cooking Mode in Use of the Upper Top Plate 44

When determining at step S14 that the gridiron 47 is absent, the microcomputer 67 advances to step S16 where it is determined whether the lower top plate 45 is present or not. This determination is made in the same manner as in step S3. When it is determined that the lower top plate 45 is absent, the oven cooking mode in use of the upper top plate 44 at step S16. The microcomputer 67 then advances to step S17 where an indication for execution of the oven mode in use of only the upper top plate 44 is displayed on the display 71. When determining at step S16 that the lower top plate 45 is present, the microcomputer 67 selects the oven mode by use of both upper and lower top plates, advancing to step S18 where an indication for execution of the oven mode by use of both upper and lower top plates is displayed on the display 71.

Processing After Determination about the Cooking Utensils

After selecting the cooking mode by determining the cooking utensils as described above, the microcomputer 67 executes the cooking program of the selected cooking mode. Upon execution of the cooking program, the kind of the food is determined. The determination about the kind of the food will be described for every cooking mode. Although specific names of foods will appear in each cooking in the following description, each cooking should not be limited by the foods and all the foods similar to each described food are included.

Pot-Used Cooking Mode

Steaming Mode

Figure 28A:
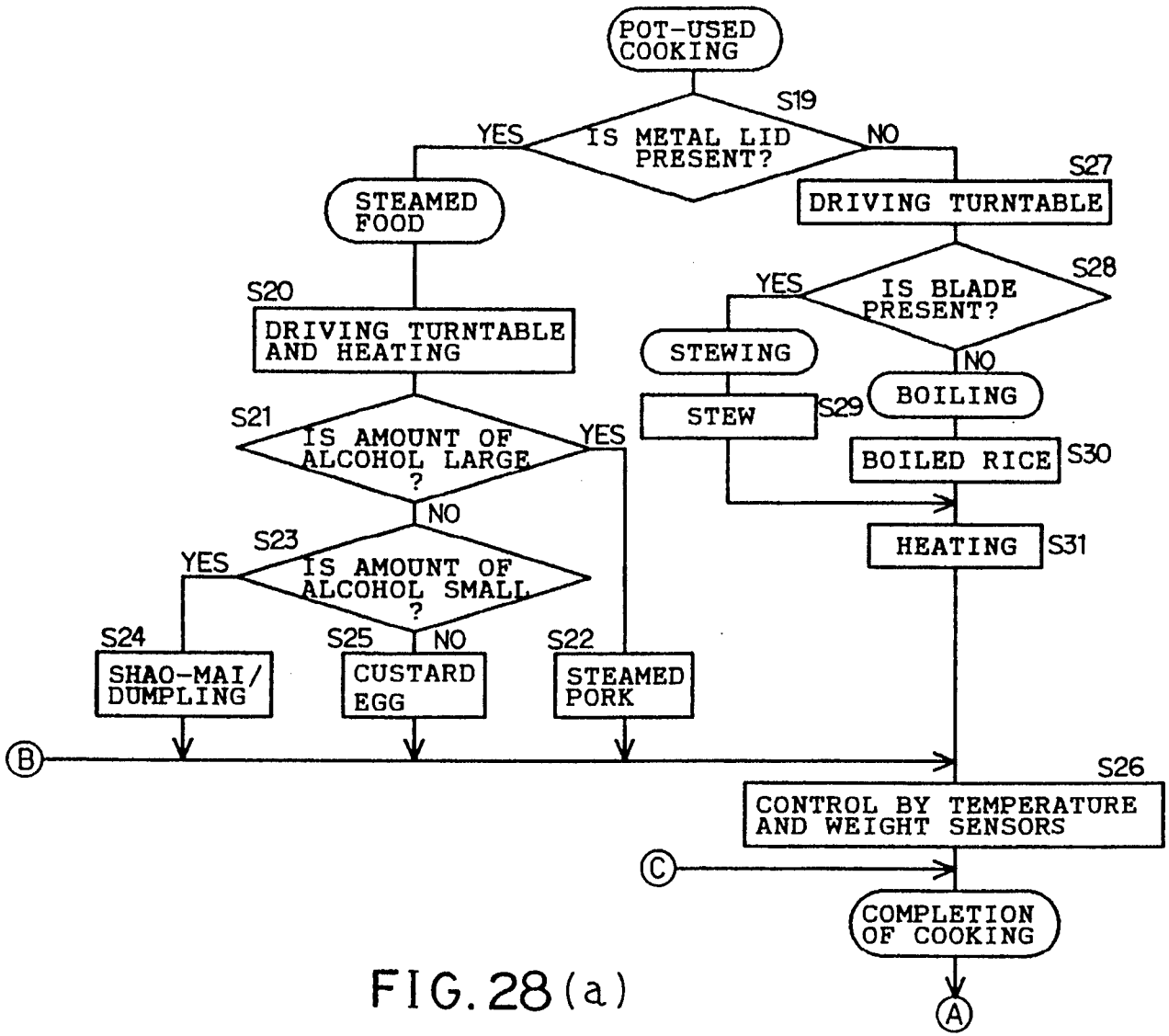
FIGS. 28(*a*) and 28(*b*) are flowcharts showing the operation in the microwave cooking mode.
Figure 28:
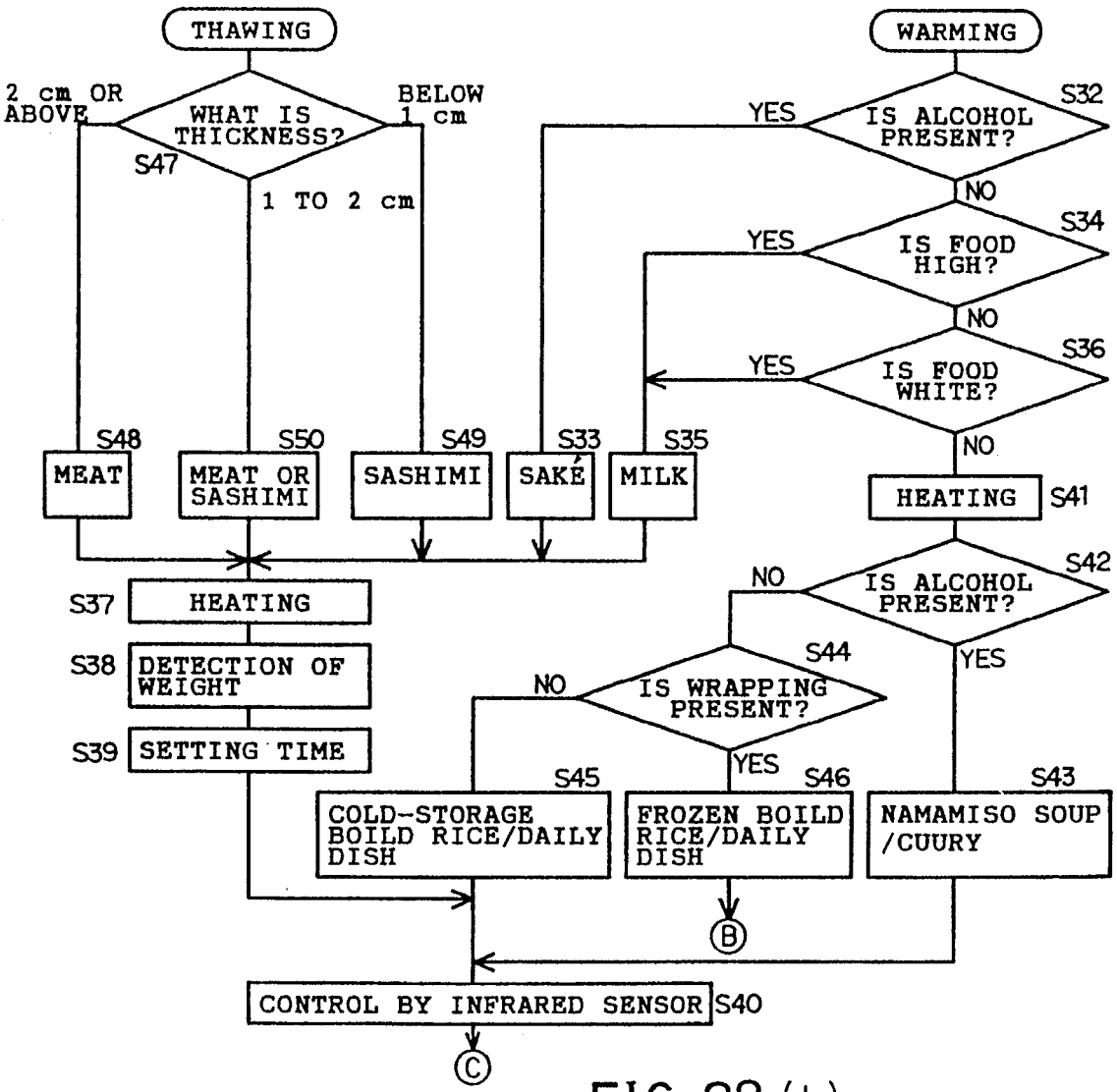

Upon execution of the cooking program of the pot-used cooking mode, it is determined at step S19 whether the lid of the pot 32 is the metal lid 34 or not, as is shown in the flowchart of FIG. 28. This determination is based on the detection signal generated by the third photosensor 53. The metal lid 34 is used in the steaming as shown in FIG. 13. Since the metal lid 34 is in the optical path of the third photosensor 53, the microcomputer 67 determines that the metal lid 34 is present, when the photosensor 53 is off. The microcomputer 67 executes the steaming program of the pot-used cooking program. Upon execution of the steaming program, the microcomputer 67 operates to energize the motor 20 to drive the turntable 26 and to energize the magnetron 5 at step S20. Water contained in the pot 32 is heated by the microwaves to be boiled. Steam due to boiling is supplied through the small apertures 33*a* into the inner receptacle 33 so that the food is steamed.

In the microwave oven of the embodiment, the steaming mode is directed to three kinds of foods, that is, "SHAO-MAI/DUMPLING," "EGG CUSTARD" and "STEAMED PORK OR THE LIKE." The microcomputer 67 determines as to which of the kinds the food in the inner receptacle 33 belongs to, on the basis of the detection signal generated by the alcohol sensor 60 a predetermined period of time after start of the energization of the magnetron 5.

Figure 14A:
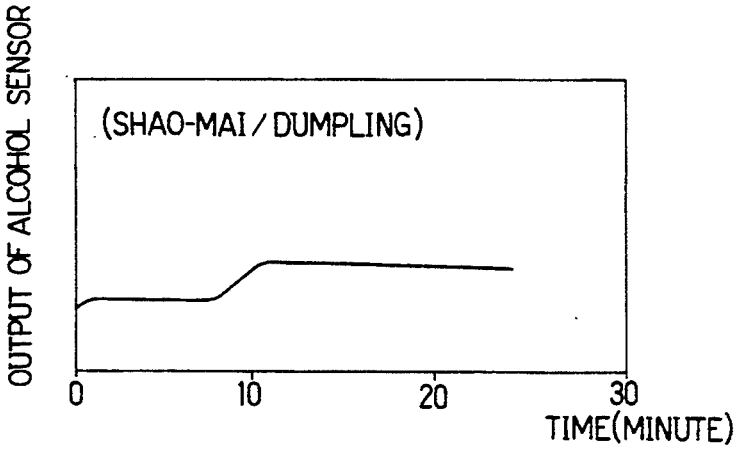
FIGS. 14(*a*), 14(*b*) and 14(*c*) are graphs showing the characteristics of the alcoholic concentration of various foods in the steaming mode.
Figure 14B:
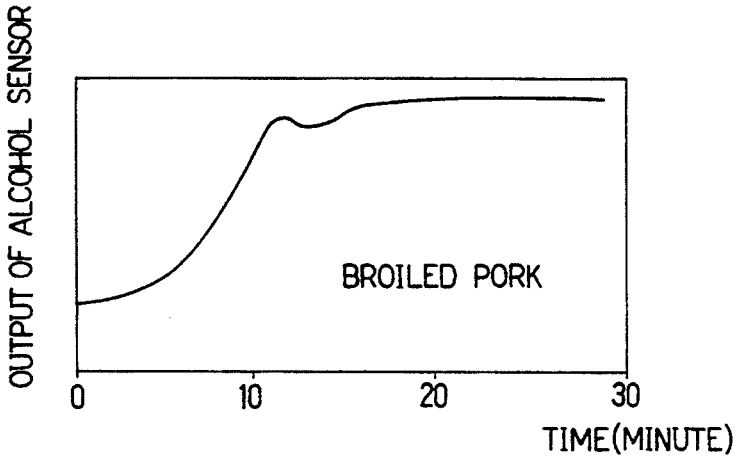
Figure 14C:
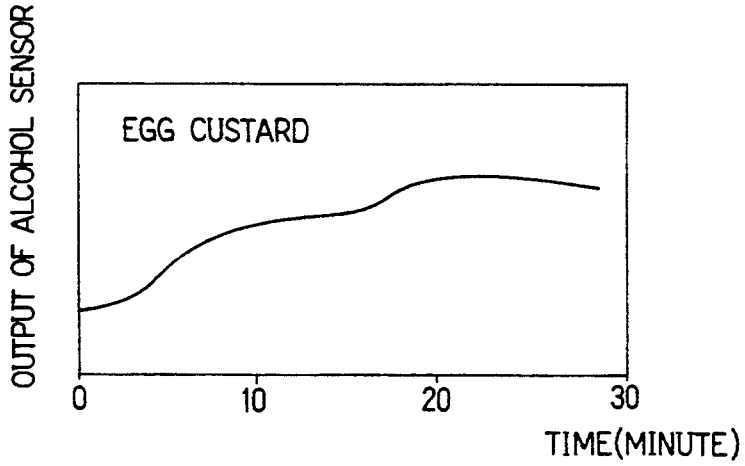

FIGS. 14(*a*)–14(*c*) show the experimental results regarding the relationships between a time elapsed from the start of energization to the magnetron 5 and the alcoholic concentration detected by the alcohol sensor 60. As understood from FIGS. 14(*a*)–14(*c*), the alcoholic concentration differs among the cases of shao-mai, egg custard and steamed pork five to ten minutes after the energization to the magnetron 5. That is, the alcoholic concentration is the highest in the case of steamed pork, at the middle level in the case of egg custard, and the lowest in the kind of dumpling.

The microcomputer 67 then advances to step S21, for example, five minutes after start of energization to the magnetron 5. The microcomputer 67 determines at step S21 whether or not the alcoholic concentration detected by the alcohol sensor 60 is above a high reference concentration value. When determining that the detected alcoholic concentration is above the high reference concentration value, the microcomputer 67 determines that the food to be cooked is the kind of pork. The microcomputer 67 then advances to step S22 where the cooking menu of "STEAMED PORK OR THE LIKE" is selected.

When determining at step S21 in the negative, the microcomputer 67 advances to step S23 where it determines whether or not the alcoholic concentration detected by the alcohol sensor 60 is above a low reference concentration value. When determining that the detected alcoholic concentration is lower than the low reference concentration value, the microcomputer 67 determines that the food to be cooked is the kind of shao-mai and dumpling. The microcomputer 67 then advances to step S24 where the cooking menu of "SHAO-MAI/DUMPLING" is selected. When determining at step S23 that the detected alcoholic concentration is higher than the low reference concentration value, the microcomputer 67 determines that the food to be cooked is the egg custard. The microcomputer 67 then advances to step S25 where the cooking menu of "EGG CUSTARD" is selected.

Upon completion of the cooking menu selection as described above, the microcomputer 67 advances to step S26 where the cooking menu program is executed. In the cooking menu program, a time period required for the humidity sensor 61 to detect a predetermined humidity, the weight detected by the weight sensor 39 and a constant predetermined for every cooking menu are substituted into an operation expression so that a residual heating time period from the time of detection of the predetermined humidity is obtained. The steaming is completed with expiration of the obtained residual time period. Since the substituted constant differs from one another in the cooking menus, the cooking can be performed in a heating mode suitable for the selected cooking contents.

Stewing

When determining at step S19 that the metal lid 34 is absent, the microcomputer 67 determines that the lid of the pot 32 is the glass lid 35, together on the basis of the determination at step S5. The microcomputer 67 then advances to step S27 where the motor 22 is started to rotate the turntable 26. The microcomputer 67 then determines at step S28 whether the agitating blade 38 is provided or not. This determination is based on the torque detected by the torque sensor 40. That is, since the food is agitated by the agitating blade 38 with rotation of the pot 32 when the agitating blade 38 is provided, torque is applied to the agitating shaft 37. The torque sensor 40 generates a voltage signal indicative of the detected torque. When the torque sensor 40 detects the torque, the microcomputer 67 determines that the agitating blade 38 is provided. Since the cooking performed with provision of the agitating blade 38 is the stewing such as beef stew, the microcomputer 67 advances to step S29 where the cooking menu of "STEWING" is selected.

On the other hand, when the torque detection signal not delivered from the torque sensor 40 at step S28 and the microcomputer 67 determines that the agitating blade 38 is not provided, the cooking performed by use of the glass lid 35 and without the agitating blade 38 relates to the boiling of side dishes or the boiling of rice. The microcomputer 67 then advances to step S30 where the boiling mode is selected and the cooking menu of "BOILED RICE" is selected.

Upon selection of the cooking menu of "STEWING" or "BOILED RICE" as described above, the microcomputer 67 advances to step S31 where the magnetron 5 is energized to start the heating. Then, the microcomputer 67 advances to step S26 where the cooking menu program is executed. Since the substituted constant differs from one another in the cooking menus in this case, too, the cooking can be performed in a heating mode suitable for the selected cooking contents.

Warming mode

Various kinds of foods are warmed in the warming mode. This warming mode includes modes of "JAPANESE SAKÉ," "MILK," "NAMAMISO SOUP/-CURRY," "COLD-STORAGE RICE/SIDE DISHES," and "FROZEN RICE/SIDE DISHES." A receptacle containing the frozen rice or each frozen side dish is usually wrapped in a plastic film wrapper and the like for prevention of its dry-up.

Figure 15:
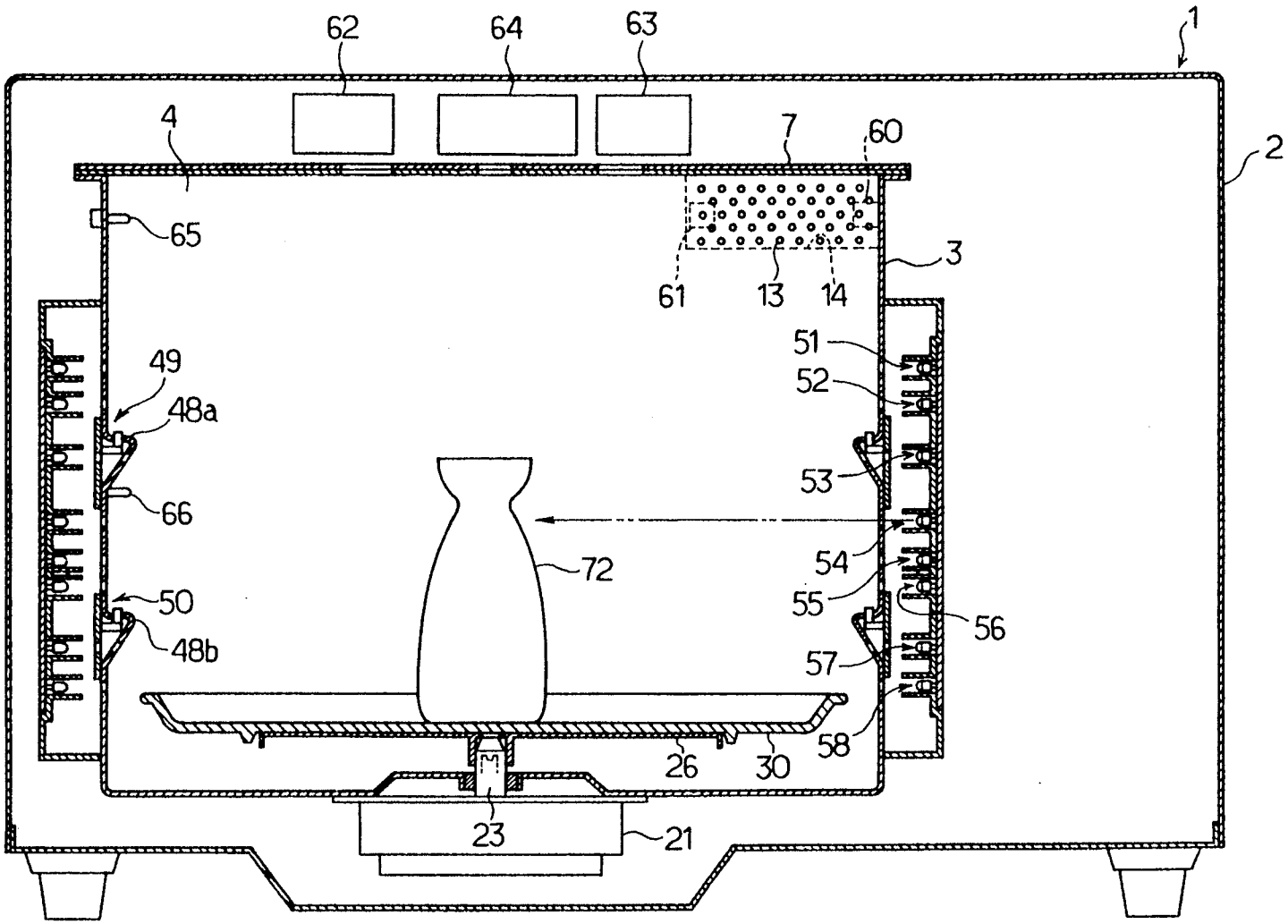
FIG. 15 is a longitudinally sectional front view of the microwave oven, showing the condition of a warming mode.
Figure 16:
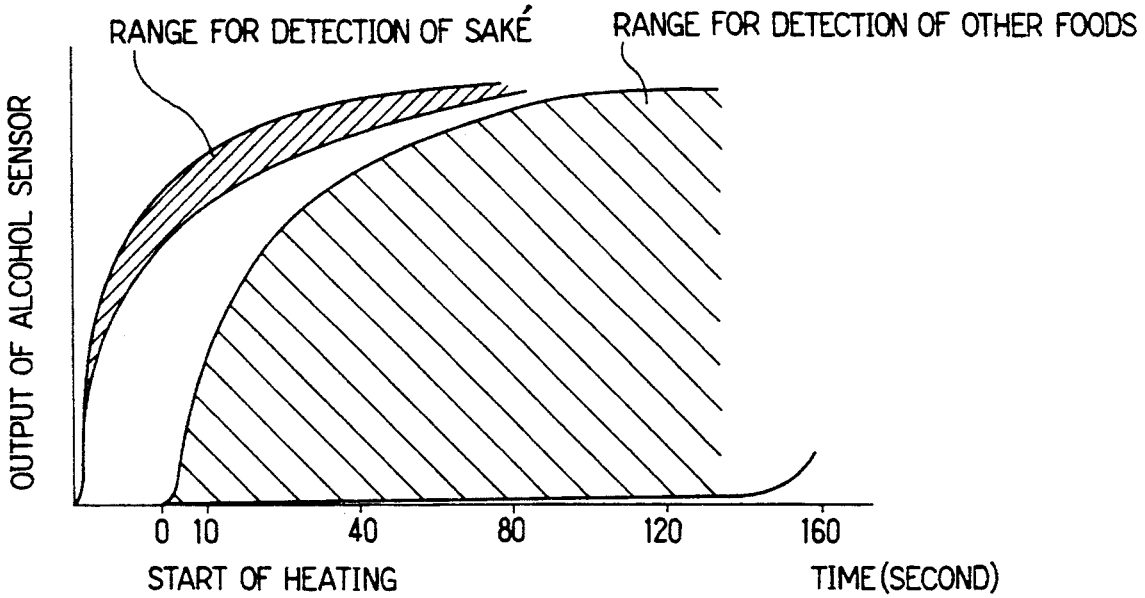
FIG. 16 is a graph showing variations of the alcoholic concentration of Japanese saké and other foods in the warming mode.

Upon execution of the warming program, the microcomputer 67 determines at step S32 whether alcohol has been detected by the alcohol sensor 60 or not, as shown in the flowcharts of FIGS. 28(*a*) and 28(*b*). An alcoholic content evaporates from the Japanese saké even at the room temperature. Accordingly, when a bottle 72 containing Japanese saké is placed in the heating chamber 4 as shown in FIG. 15, the alcohol sensor 60 immediately detects the alcohol content as shown in FIG. 16. Then, the microcomputer 67 determines at step S32 that alcohol is present and that the food is Japanese saké, advancing to step S33 where the warming menu of "JAPANESE SAKÉ" is selected.

Figure 17:
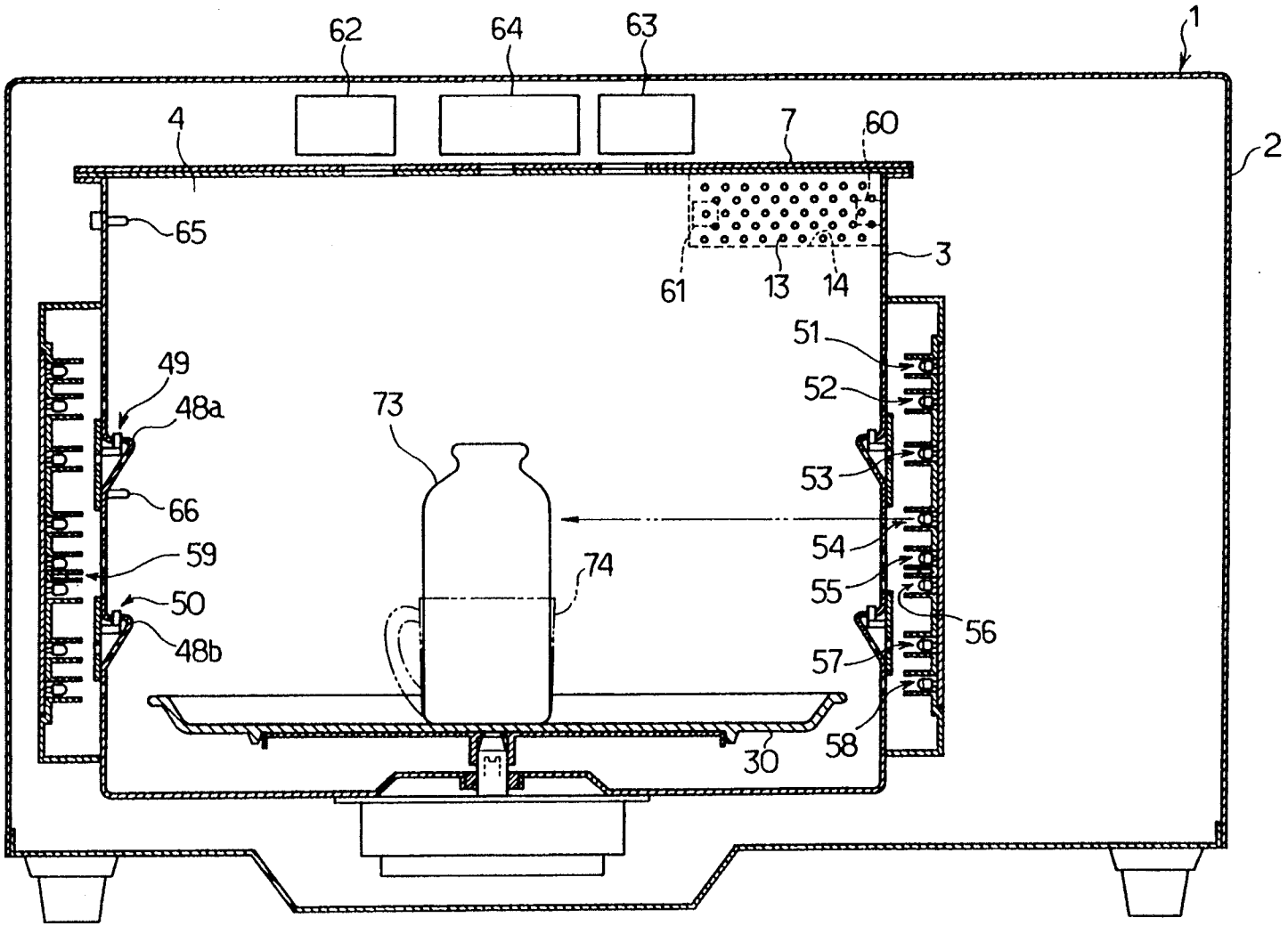
FIG. 17 is a longitudinally sectional front view of the microwave oven, showing another condition of the warming mode.

When determining at step S32 that alcohol is absent, the microcomputer 67 advances to step S34 where it determines whether the food placed on the glass dish 30 is tall or not. This determination is based on the detection signal generated by the fourth photosensor 54. More specifically, of the receptacles used for containing the food to be warmed, a tall receptacle is considered a saké bottle and a milk bottle. In the case of the saké bottle, the microcomputer 67 determines that alcohol is present and that the food to be warmed is Japanese saké, at step S32. Accordingly, it is determined at step S34 whether the receptacle is a milk bottle or another short receptacle. As shown in FIG. 17, the optical path of the fourth photosensor 54 is blocked when the receptacle placed on the glass dish 30 is a tall milk bottle 37.

When the fourth photosensor 54 is off, the microcomputer 67 determines that the receptacle is tall, advancing to step S35 where the warming menu of "MILK" is selected. When the fourth photosensor 54 is on, the microcomputer 67 determines that the receptacle is not a milk bottle, advancing to step S36 where it determines whether the color detected by the color sensor 63 is white or not. When the color detected by the color sensor 63 is white, the microcomputer 67 determines that the food is a white beverage contained in the short cup 74 as shown by two-dot chain line in FIG. 17, such as milk. The microcomputer 67 then advances to step S35 where the warming menu of "MILK" is selected.

Upon selection of the cooking menu of "JAPANESE SAKÉ" or "MILK," the microcomputer 67 advances to step S37 where the magnetron 5 is energized to start the heating. Then, the microcomputer 67 inputs data of the weight detected by the weight sensor 39 (step S38) and the amount of milk or saké is obtained from the input weight by computing. The heating time period is set in accordance with the obtained amount of milk or Japanese saké (step S39). The heating time period is arranged to differ from one cooking menu to another even when the amount of saké is the same as of the milk, so that the Japanese saké and milk are heated to the respective suitable temperatures.

The microcomputer 67 then advances to step S40 where the set heating time period is counted. The warming is completed with lapse of the set time period. The microcomputer 67 detects the temperatures of the food on the basis of the detection signals generated by the infrared sensor 64 at predetermined intervals. When the predetermined temperature in accordance with the cooking menu is reached even before lapse of the set time period, the heating is completed at that time.

Figure 18:
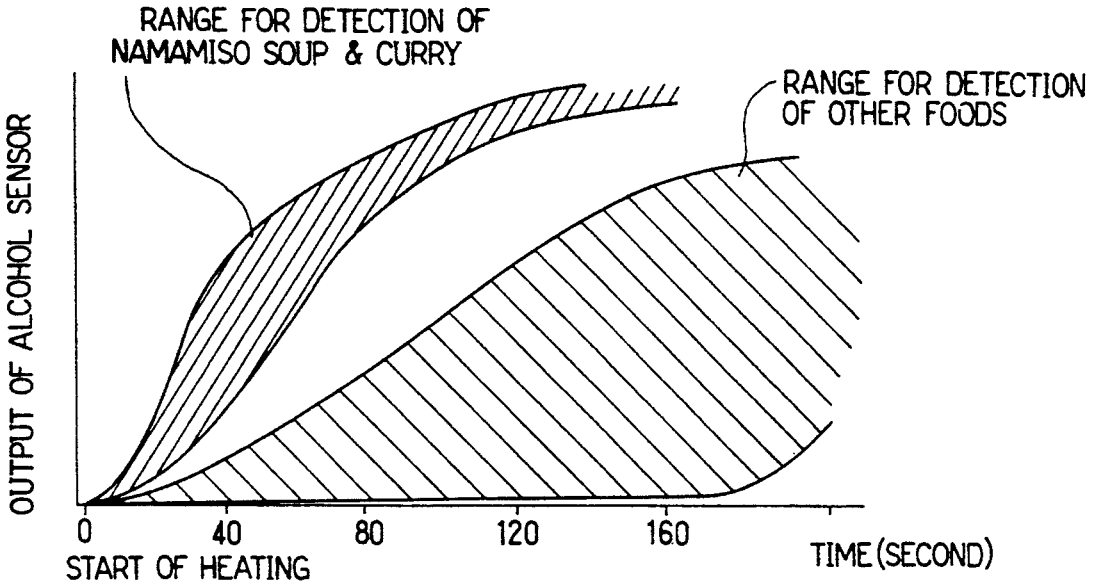
FIG. 18 is a graph showing variations of the alcoholic concentration of the foods after the foods have been heated in the warming mode.

On the other hand, when the color detected by the color sensor 63 is the color other than the white at step S36, the microcomputer 67 advances to step S41 where the magnetron 5 is energized so that the food is heated by the microwaves. A predetermined time period after start of the heating, the microcomputer 67 advances to step S42 where it is determined whether or not the alcoholic concentration detected by the alcohol sensor 60 is at a predetermined value or above. FIG. 18 shows the results of an experiment wherein the namamiso soup, curry, and other foods are compared with one another with respect to the relationship between the elapsed time period from the start of the heating and the alcoholic concentration. As understood from FIG. 18, the alcohol concentration is increased more rapidly after start of the heating in the case of the namamiso soup and the curry than in the case of the other foods. Then, the microcomputer 67 determines at step S42 that the food is the namamiso soup or curry, when the alcoholic concentration is at the predetermined value or above. The microcomputer 67 then advances to step S43 where the warming menu of "NAMAMISO SOUP/CURRY" is selected.

Figure 19:
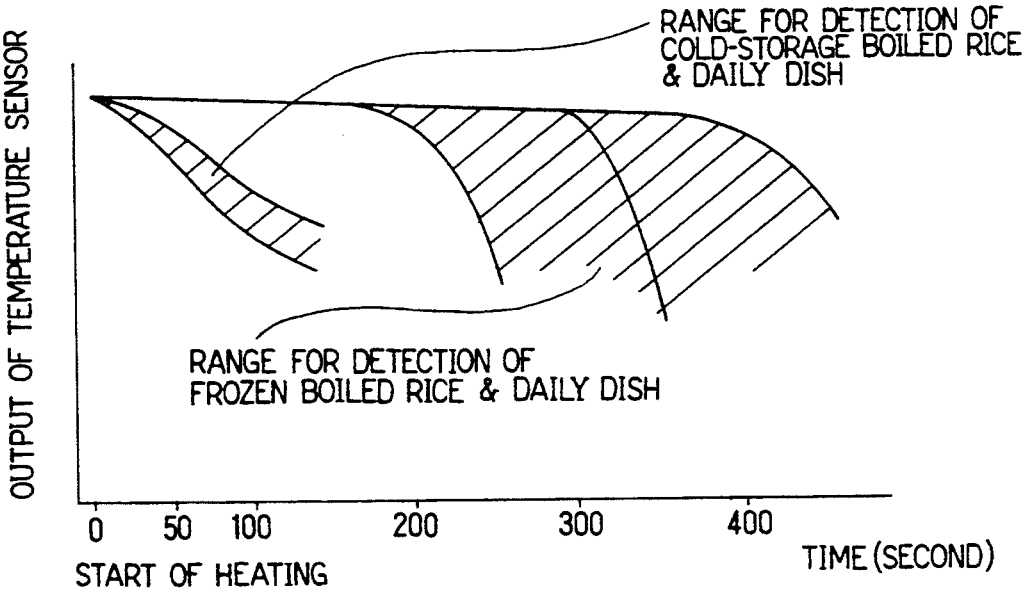
FIG. 19 is a graph showing variations of the humidity of the foods after the foods have been heated in the warming mode.

When the alcoholic concentration is below the predetermined value at step S42, the microcomputer 67 advances to step S44 where it is determined whether the wrapping is present or not. This determination is based on the detection signal generated by the humidity sensor 61. As shown in FIG. 19, almost no vapor is dissipated in the heating chamber 4 in the case of the wrapped frozen rice or side dishes even after start of the heating. Accordingly, the humidity is not detected by the humidity sensor 61 at an early stage of the heating. On the other hand, in the case of the unwrapped cold-storage rice or side dishes, a relatively large amount of vapor is dissipated even at the early stage of the heating. When the humidity detected by the humidity sensor 61 is higher than a reference value, the microcomputer 67 determines at step S44 that the wrapping is absent and that the food is the cold-storage rice or side dishes. The microcomputer 67 then advances to step S45 where the warming menu of "COLD-STORAGE RICE/SIDE DISHES" is selected. When the humidity detected by the humidity sensor 61 is lower than the reference value, the microcomputer 67 determines that the wrapping is present and that the food is the frozen rice or side dishes, advancing to step S46 where the warming menu of "FROZEN RICE/SIDE DISHES" is selected.

When the warming menu of "COLD-STORAGE RICE/SIDE DISHES" has been selected, the microcomputer 67 advances to step S40 where the temperature of the food is detected by the infrared sensor 64 and the heating is completed when the food temperature reaches a predetermined value. In this case, too, the final temperature of the food is set to a value suitable for the selected cooking menu of "COLD-STORAGE RICE/SIDE DISHES."

When the warming menu of "FROZEN RICE/-SIDE DISHES" has been selected, the microcomputer 67 advances to step S26 where the residual heating time period is set based on the humidity detected by the humidity sensor 61 and the weight detected by the weight sensor 39. The warming is completed upon lapse of the set time period. In the case of the frozen rice or side dishes, the wrapping prevents the vapor from dissipating in the heating chamber 4 at the early stage of the heating. The wrapping breaks with increase in the amount of vapor, which is dissipated in the heating chamber 4. The humidity is detected at this stage by the humidity sensor 61.

Thawing Mode

Frozen meat or "sashimi" is thawed in the thawing mode. Upon execution of the cooking program in the thawing mode, the microcomputer 67 executes step S46 where the thickness of the food placed on the thawing gridiron 31 is determined, as shown in the flowcharts of FIGS. 28(*a*) and 28(*b*). This determination is based on the detection signals generated by the fifth and sixth photosensors 55 and 56.

As described above, the meat usually has the thickness of 2 centimeters or above and the thickness of the "sashimi" is below one centimeter. Both of the photosensors 55, 56 detect whether or not the thickness of the food is 2 centimeters or above and whether it is below one centimeter or not. When both photosensors 55, 56 are off, the microcomputer determines that the food is thick (2 centimeters or above), advancing to step S48 where the thawing menu of "MEAT" is selected. When both photosensors 55, 56 are on, the microcomputer 67 determines that the food is thin (below one centimeter), advancing to step S49 where the thawing menu of "SASHIMI" is selected. Furthermore, when the fifth photosensor 55 is off while the sixth photosensor 56 is on, the microcomputer 67 determines that the food has a medium thickness (one centimeter or above or below 2 centimeters), advancing to step S50 where the thawing menu of "MEAT OR SASHIMI" is selected.

When one of the thawing menus of "MEAT," "SASHIMI" and "MEAT OR SASHIMI" has been selected, the microcomputer 67 advances to step S37 where the magnetron 5 is energized so that the heating is initiated for the thawing. In the same manner as described above, the weight of the food is calculated from the weight detected by the weight sensor 39 at step S38. A heating time period is set in accordance with the calculated weight at step S39. Subsequently, the microcomputer 67 advances to step S40 where the set heating time period is counted and the heating is completed upon lapse of the set heating time period. In this case, too, the microcomputer 67 detects the temperature of the food from the detection signal generated by the infrared sensor 64 and the heating is completed when a predetermined temperature is reached even before lapse of the set time period.

In the case of the thawing, the magnetron 5 is maintained at a low output level so that the food is prevented from being boiled. The meat may be boiled more or less since it is heated after the thawing. However, "sashimi" must be prevented from being boiled. Accordingly, the output of the magnetron 5 may be higher in the thawing of meat than in the thawing of "sashimi."

In the case of the thawing menu of "MEAT OR SASHIMI," the food actually placed on the thawing gridiron 31 can be meat or "sashimi." Accordingly, the magnetron 5 is controlled so that a heating manner suitable for "sashimi" but not for meat is provided.

Grill Mode

The grill mode includes cooking menus of "BROILING WITH SOY," "SAURY," "LOBSTER," "OPENED & DRIED FISH," "CHICKEN THIGH," and "MITARASHI DOUGHBOY."The foods broiled with soy include a yellowtail broiled with soy, grilled chicken, cuttlefish broiled with soy, Japanese Saikyo-yaki Spanish mackerel, mackerel broiled with soy and citron.

Broiling with Soy

Figure 29:
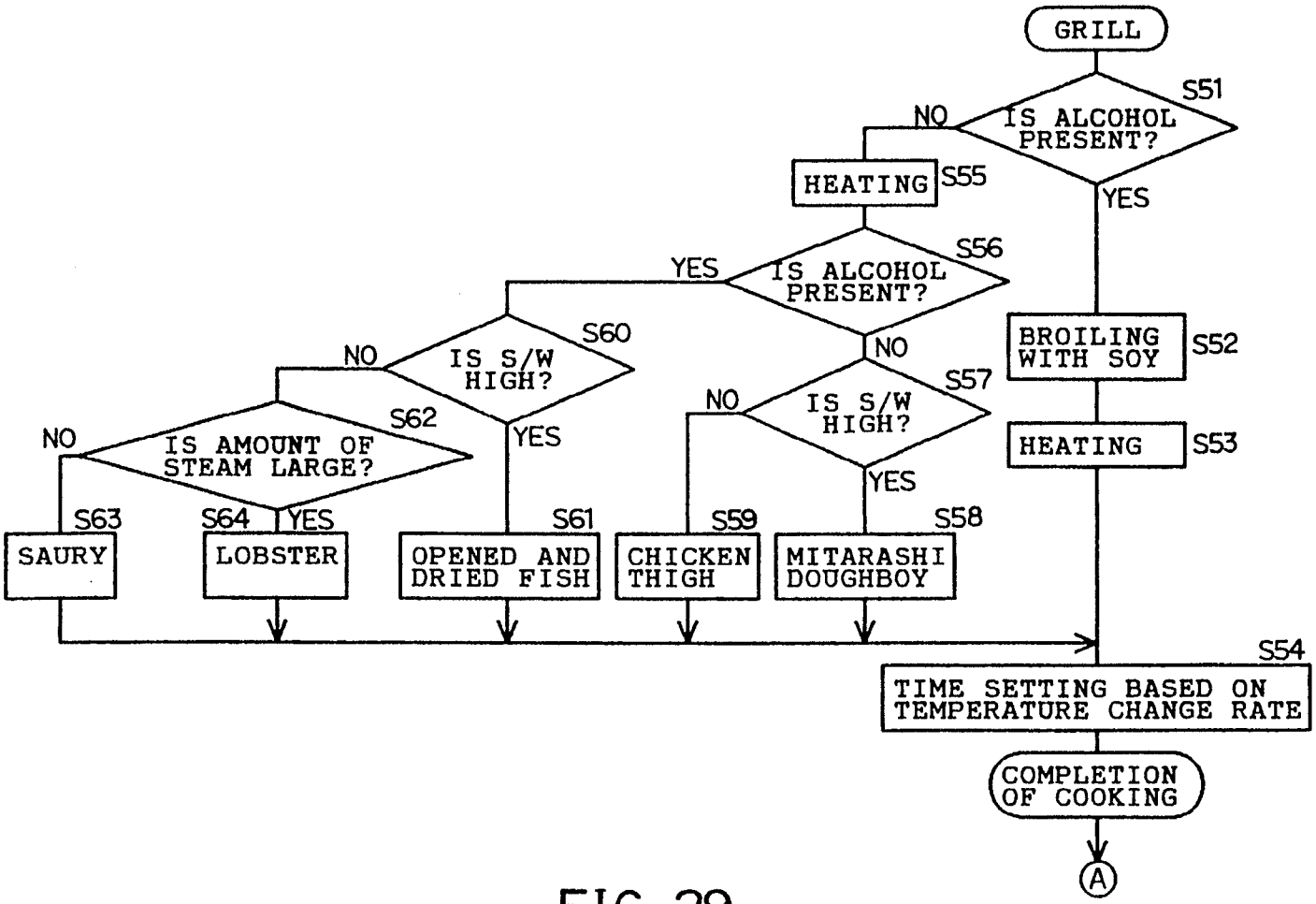
FIG. 29 is a flowchart showing the operation in the grill mode.

Upon execution of the cooking program of the grill mode, the microcomputer 67 executes step S51 where it is determined whether alcohol is detected by the alcohol sensor 60 or not, as shown in the flowchart of FIG. 29. The food to be broiled with soy is preserved in soy sauce or sweet sake containing alcoholic content. Accordingly, when the food to be broiled with soy is placed in the heating chamber 4, the alcohol sensor 60 immediately detects alcohol. The alcohol is not detected in the case of the other foods. When determining at step S51 that the alcohol is present, the microcomputer 67 determines that the food placed on the gridiron 47 is a food to be broiled with soy. Then, the cooking menu of "BROILING WITH SOY" is selected at step S52 and the grill heater 7 is energized at step S53. Subsequently, the microcomputer 67 advances to step S54 where a rate of change of the temperature (the temperatures at the time of start of the heating and five minutes after start of the heating) is calculated from the temperatures detected by the grill temperature sensor 66, and a heating time period is set in accordance with the calculated temperature change rate.

The above-mentioned heating time period is set by use of a predetermined operation expression. The constant in the operation expression differs from one cooking menu to another so that a heating time period suitable for the cooking of the food is set. When the cooking menu of "BROILING WITH SOY" has been selected, the microcomputer 67 substitutes the constant for the cooking menu of "BROILING WITH SOY" into the operation expression to calculate the heating time period. The grill heater 7 is deenergized upon lapse of the set heating time period so that the heating is completed.

Mitarashi Doughboy and Chicken Thigh

When determining at step S51 that the alcohol is absent, the microcomputer 67 advances to step S55 where the grill heater 7 is energized so that the heating to the food is initiated. The microcomputer 67 then determines whether the alcohol has been detected by the alcohol sensor 60 or not, a predetermined time period after the initiation of the heating (step S56).

Experiments made by the inventors show that the alcohol evaporates when the saury, lobster and opened and dried fish are heated. However, a less amount of alcohol content evaporates when the mitarashi doughboy and chicken thigh are heated. When determining at step S56 that the alcohol is absent, the microcomputer 67 advances to step S57 where it is determined which of the mitarashi doughboy or chicken thigh the food to be cooked is. At step S57, the microcomputer 67 calculates the area S of the food from image information from the CCD camera 62. Accordingly, the microcomputer 67 functions as image processing means. The microcomputer 67 calculates the ratio of the food area S to the food weight W based on the weight detected by the weight sensor 49. The microcomputer 67 then determines whether the ratio S/W is larger than a reference value or not. The ratio S/W is relatively large in the case of the mitarashi doughboy since its density is small. However, the ratio S/W is small in the case of the chicken thigh since its density is large. When the ratio S/W is larger than the reference value, the microcomputer 67 then determines that the food is the mitarashi doughboy, advancing to step S58 where the cooking menu of "MITARASHI DOUGHBOY" is selected. When the ratio S/W is smaller than the reference value, the microcomputer 67 determines that the food is the chicken thigh, advancing to step S59 where the cooking menu of "CHICKEN THIGH" is selected. The microcomputer 67 then executes step S54 as described above after selection of the cooking menu of "MITARASHI DOUGHBOY"or "CHICKEN THIGH."

Opened and Dried Fish

Figure 22:
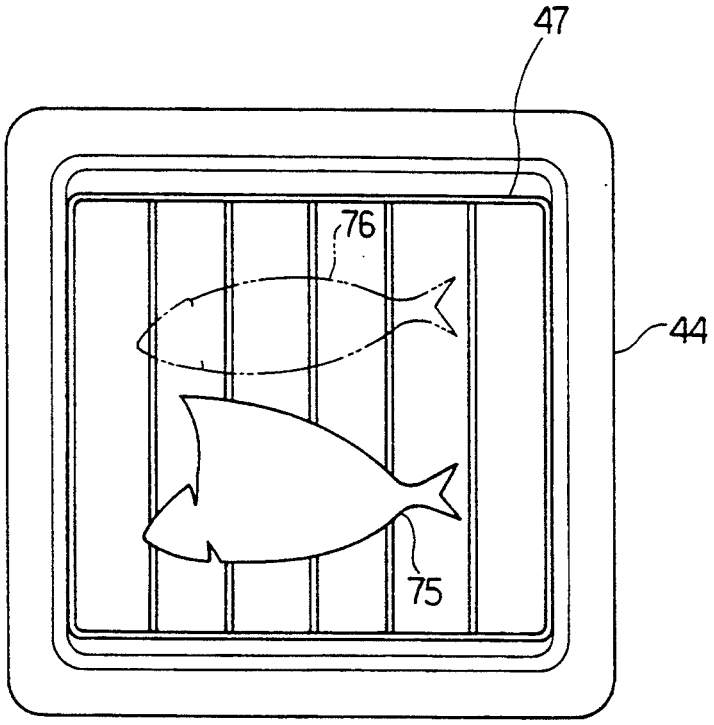
FIG. 22 is a plan view of the upper top plate and the gridiron, showing the size of food pieces in the grill mode.

When determining at step S56 that the alcohol is absent, the microcomputer 67 calculates the ratio of the food area S to the food weight W and then determines whether the ratio S/W is larger than the reference value or not, in the same manner as in step S57. As shown in FIG. 22, even in the case of the same fish, the opened and dried fish 75 (shown by solid line in the figure) has a larger area for its weight than the raw fish 76 since the opened and dried fish 75 is flat. Accordingly, when the ratio S/W is larger than the reference value at step S60, the microcomputer 67 determines that the food is the opened and dried fish, advancing to step S61 where the cooking menu of "OPENED & DRIED FISH" is selected. Thereafter, the microcomputer 67 executes step S54.

Saury and Lobster

When determining at step S60 that the ratio S/W is smaller than the reference value, the microcomputer 67 determines at step S62 whether the humidity detected by the humidity sensor 61 is larger that a reference value or not. Application of heat to the lobster produces a relatively large amount of vapor while an amount of vapor produced by application of heat to the saury is not so large as in the case of the lobster. Accordingly, when the humidity detected by the humidity sensor 61 is low, the microcomputer 67 determines at step S62 that the food is the saury, advancing to step S63 where the cooking menu of "SAURY" is selected. When the humidity detected by the humidity sensor 61 is high, the microcomputer 67 determines that the food is the lobster, advancing to step S64 where the cooking menu of "LOBSTER" is selected. The microcomputer 67 executes step S54 as described above after selection of the cooking menu of "SAURY" or "LOBSTER."

When advancing to step S54 after the above-described selection of the cooking menu, the microcomputer 67 sets a heating time period in accordance with the selected cooking menu in the same manner as described above. The grill heater 7 is deenergized after lapse of the set cooking time period so that the grill mode is completed. In the grill mode, an atmospheric temperature in the heating chamber 4 is maintained at a predetermined temperature value irrespective of the selected cooking menu. Based on the temperatures detected by the grill temperature sensor 66, the microcomputer 67 controls the grill heater 7 during the grill mode so that the predetermined temperature value is maintained.

Oven Mode in Use of the Upper Top Plate 44

Figure 30:
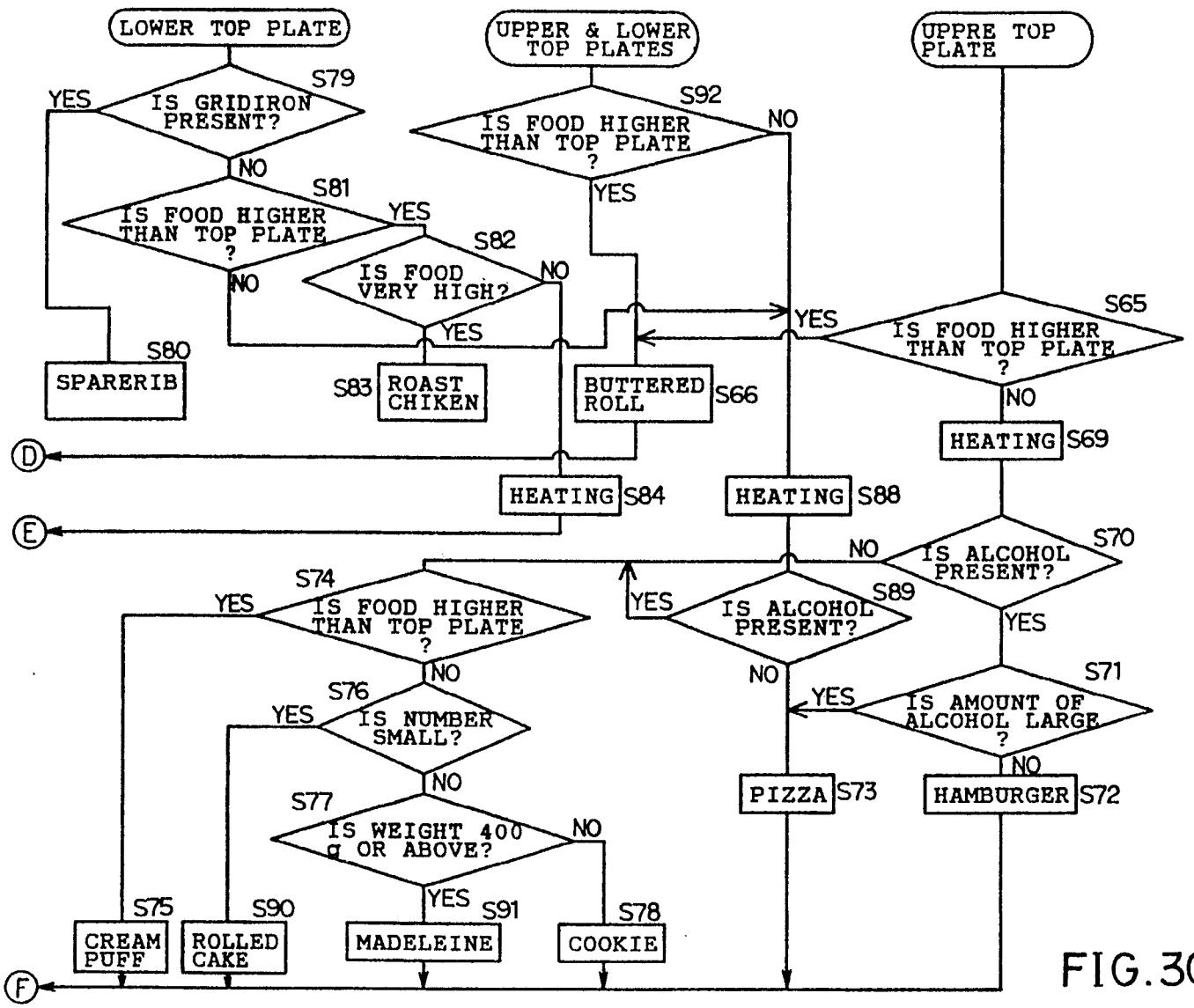
FIGS. 30(*a*) and 30(*b*) are flowcharts showing the operation in the oven mode.
Figure 30:
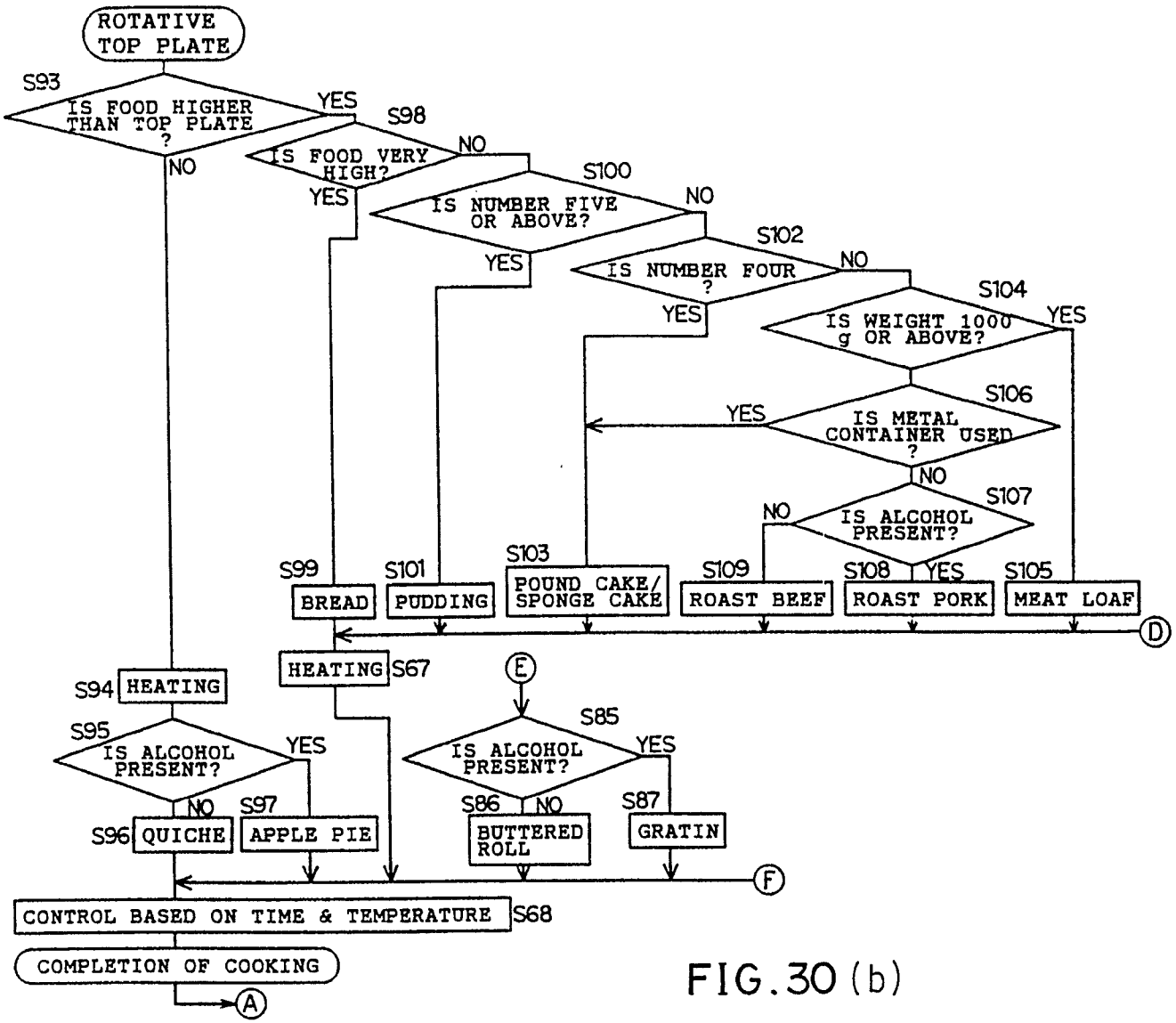

This oven mode includes cooking menus of "PIZZA," "BUTTERED ROLL," "CREAM PUFF," "COOKIE," and "HAMBURGER." These foods except the hamburger may be cooked only with the lower top plate 45. Further, when these foods are cooked in a large quantity, both of the upper and lower top plates 44, 45 may be used. However, in the case of the hamburger, only the upper top plate 44 can be used. Upon execution of the cooking program of this oven mode, the microcomputer 67 first determines at step S65 whether the food is higher than the peripheral wall of the upper top plate 44, as shown in FIG. 30. This determination is based on the detection signal generated by the second photosensor 52. Of the pizza, buttered roll, cream puff, cookie, and hamburger, only the buttered roll is higher than the peripheral wall of the upper top plate 44 and accordingly, the optical path of the second photosensor 52 is blocked by the buttered roll. Then, when the second photosensor 52 is off, the microcomputer 67 determines at step S65 that the food is higher than the peripheral wall of the upper top plate 44 and that the food is the buttered roll. The cooking menu of "BUTTERED ROLL" is selected at step S66. Subsequently, the microcomputer 67 advances to step S67 where the oven heater 6 and the fan motor 16 of the circulation fan 18 are energized so that heated air is supplied into the heating chamber 4 to heat the food.

Upon initiation of the heating, the microcomputer 67 advances to step S68. At step S68, data of the set temperature and time for the selected cooking menu of "BUTTERED ROLL" is selected from data of set temperature and time set for each cooking menu. The oven heater 6 is controlled on the basis of the temperatures detected by the oven temperature sensor 65 so that the atmospheric temperature in the heating chamber 4 is maintained at the set temperature. Upon lapse of the set time, the oven heater 6 and the fan motor 16 are deenergized and the cooking is completed.

Hamburger and Pizza

When determining at step S65 that the food is lower than the peripheral wall[of the upper top plate 44, the microcomputer 67 advances to step S69 where the oven heater 6 and the fan motor 16 are energized so that the heating to the food is initiated. After lapse of the predetermined time period, the microcomputer 67 advances to step S70 where it is determined whether alcohol has been detected by the alcohol sensor or not. In accordance with experiments, the alcoholic content is dissipated when each of the hamburger and pizza is heated. An amount of alcohol dissipated is larger in the case of the pizza than in the case of the hamburger. Almost no alcohol is dissipated in the case of the cream puff and the cookie. When determining at step S70 that the alcohol is present, the microcomputer 67 advances to step S71 where it is determined whether the amount of alcohol detected is large or not. When the amount of alcohol is below a reference value, the microcomputer 67 determines that the food is the hamburger, advancing to step S72 where the cooking menu of "HAMBURGER" is selected. When the amount of alcohol is at the reference value or above, the microcomputer 67 determines that the food is the pizza, advancing to step S73 where the cooking menu of "PIZZA" is selected. After the cooking menu of "HAMBURGER" or "PIZZA" has been selected, the microcomputer 67 executes step S68.

Cream Puff

When determining at step S70 that the alcohol is absent, the microcomputer 67 advances to step S74 where the food is higher than the peripheral wall of the upper top plate 44 or not. The cream puff, when heated, expands such that it becomes higher than the peripheral wall of the upper top plate 44. The microcomputer 67 determines that the food is the cream puff, when determining at step S74 that the food is higher than the upper top plate 44, notwithstanding the determination at step S65 that the food is lower than it. The microcomputer 67 then advances to step S75 where the cooking menu of "CREAM PUFF" is selected.

Cookie

When determining at step S74 that the food is lower than the upper top plate 44, the microcomputer 67 advances to step S76 where it is determined whether the number of pieces of food is larger than a reference number or not. This determination is based on the image information from the CCD camera 62. When the number of pieces of food is large, the microcomputer 67 advances to step S77 where it is determined whether or not the weight of the food obtained from the detection weight detected by the upper weight sensor 49 is 400 grams or above. In the case of cookies, the weight is small although its number is large. Accordingly, when determining at step S77 that the weight is below 400 grams, the microcomputer 67 determines that the food is the cookies, advancing to step S78 where the cooking menu of "COOKIE" is selected. The microcomputer 67 then executes step S68. Steps S76 and S77 are for determination that the food is the cookie, madeleine or rolled cake in the use of the lower top plate 45, as will be described later.

The microcomputer 67 selects the cooking menu in accordance with food placed on the upper top plate 44 as described above and then advances to step S68. At step S68, the microcomputer 67 selects the atmospheric temperature and the time in accordance with the selected cooking menu. Upon lapse of the set time, the microcomputer 67 completes the cooking.

Oven Mode in Use of the Lower Top Plate 45

This oven mode includes cooking menus of "PIZZA," "BUTTERED ROLL," "CREAM PUFF," "COOKIE," "ROAST CHICKEN," "GRATIN," "MADELEINE," "SPARERIBS," and "ROLLED CAKE." Only the upper top plate 44 may be used for the cooking menus of "PIZZA," "BUTTERED ROLL," "CREAM PUFF" and "COOKIE" as described above and both of the upper and lower top plates 44, 45 may be used in these cooking menus depending upon the amount of food. Only the lower top plate 45 needs to be used in the cooking menus of "ROAST CHICKEN," "GRATIN," "MADELEINE," "SPARERIBS" and "ROLLED CAKE" and furthermore, the gridiron 47 needs to be placed on the lower top plate 45 in the cooking menu of "SPARERIBS."

Spareribs

Upon execution of the program of this cooking mode, the microcomputer 67 determines at step S79 whether the gridiron 47 is present or not, as shown in FIG. 30(*a*). This determination is based on the output signals generated by the fourth and fifth photosensors 54 and 55. That is, when the spareribs are placed on the gridiron 47, the fourth photosensor 54 is off and the fifth photosensor 55 is on, as shown in FIG. 24. In this condition, the microcomputer 67 determines that the food is the spareribs, advancing to step S80 where the cooking menu of "SPARERIBS" is selected. Then, the microcomputer 67 executes steps S67 and S68 in turn and completes the cooking upon lapse of the set time period.

Roast Chicken

When determining at step S79 that the gridiron 47 is absent, the microcomputer 67 advances to step S81 where it is determined whether the food is higher than the peripheral wall of the lower top plate 45, on the basis of the detection signal generated by the sixth photosensor 56. When the sixth photosensor 56 is off, the microcomputer 67 advances to step S82 where it is determined whether the food is very high or not, on the basis of the detection signal generated by the fourth photosensor 54. Since a whole chicken is roasted in the case of the roast chicken, the food is higher than the other foods such that the optical path of the fourth photosensor 54 is blocked. When the fourth photosensor 54 is off, the microcomputer 67 determines that the food is the roast chicken, advancing to step S83 where the cooking menu of "ROAST CHICKEN" is selected. Then, steps S67 and S68 are executed in turn as described above and then, the cooking is completed upon lapse of the set time period.

Determination of Buttered Roll and Gratin

When the food is higher than the peripheral wall but not so high as the roast chicken, the microcomputer determines in the negative at step S82. Such a food includes the buttered roll and the gratin. When determining in the negative at step S82, the microcomputer 67 advances to step S84 where the oven heater 6 and the fan motor 16 are energized so that the heating to the food is initiated. After lapse of a predetermined time period, the microcomputer 67 advances to step S85 where it is determined whether alcohol has been detected by the alcohol sensor 60 or not. Experiments show that the alcohol content is dissipated when the buttered roll is heated and that almost no alcohol is dissipated in the case of the gratin. When the amount of alcohol is at the reference value or above, at step S85, the microcomputer 67 determines that the food is the buttered roll, advancing to step S86 where the cooking menu of "BUTTERED ROLL" is selected. When the amount of alcohol is below the reference value, the microcomputer 67 determines that the food is the gratin, advancing to step S87 where the cooking menu of "GRATIN" is selected. Then, the above-described step S68 is executed.

Determination of Pizza, Cream Puff, Cookie, Madeleine and Rolled Cake

The microcomputer 67 determines in the negative in step S81 when the food is lower than the peripheral wall of the lower top plate 45. The foods lower than the peripheral wall of the lower top plate 45 include pizza, cream puff, cookie, madeleine and rolled cake. In this case, the rolled cake means its dough. Upon determination in the negative at step S81, the microcomputer 67 advances to step S88 where the oven heater 6 and the fan motor 16 are energized so that the heating to the food is initiated. After lapse of the predetermined time period, the microcomputer 67 advances to step S89 where it is determined whether alcohol has been detected by the alcohol sensor 60. In the case of the above-described foods except the pizza, the alcoholic content is evaporated when they are heated. When the amount of alcohol is below the reference value at step S89, the microcomputer 67 determines that the food is a pizza, advancing to step S73 where the cooking menu of "PIZZA" is selected. The microcomputer 67 then executes step S68. When the amount of alcohol is at the reference value or above at step S89, the microcomputer 67 advances to step S74. The food is a cream puff as described above when the microcomputer 67 determines in the affirmative at step S74. The microcomputer 67 then advances to step S75 where the cooking menu of "CREAM PUFF" is selected and executes step S68.

When determining at step S74 that the food is lower than the peripheral wall of the lower top plate 45, the microcomputer 67 advances to step S76 where the number of pieces of the food to be cooked is determined on the basis of the image information from the CCD camera 62. In the case of the rolled cake, the dough is put into the lower top plate 45 and baked. Since one piece of rolled cake is usually cooked, it is determined at step S76 that the number of pieces of the food is small. Accordingly, the microcomputer 67 determines that the food is a rolled cake, advancing to step S90 where the cooking menu of "ROLLED CAKE" is selected. Then, the microcomputer 67 executes step S68.

When determining at step S76 that the number of pieces of the food is not small, the microcomputer 67 advances to step S77 where it is determined whether or not the food weighs 400 grams or above. The madeleine is heavier than the cookie and weighs 400 grams or above. Accordingly, when determining at step S77 that the food weighs 400 grams or above, the microcomputer 67 determines that the food is a madeleine, advancing to step S91 where the cooking menu of "MADELEINE" is selected. When the weight of the food is below 400 grams, the microcomputer 67 determines that the food is cookie, advancing to step S78 where the cooking menu of "COOKIE" is selected. The microcomputer 67 executes step S68 after selection of the cooking menu of "MADELEINE" or "COOKIE."

When selecting the cooking menu in accordance with the food on the lower top plate 45 and advancing to step S68 as described above, the microcomputer 67 controls the cooking in accordance with the set temperature and time period of the selected cooking menu and completes the cooking after lapse of the set time period.

Oven Mode in Use of Upper and Lower Top Plates 44, 45

This cooking mode is directed to four cooking menus of "PIZZA," "BUTTERED ROLL," "CREAM PUFF" and "COOKIE."

Buttered Roll

Upon execution of this cooking mode, the microcomputer 67 first executes step S92 which is the same as step S81 where the height of the food is determined on the basis of the detection signal generated by the sixth photosensor 56, as is shown in the flowcharts of FIGS. 30(*a*) and 30(*b*). When the sixth photosensor 56 is off, the microcomputer 67 determines that the food is high and that the food is a buttered roll, advancing to step S66 where the cooking menu of "BUTTERED ROLL" is selected.

Pizza, Cookie and Cream Puff

When the light-reception signal has been generated by the sixth photosensor 56, the microcomputer 67 determines at step S92 that the food is low, executing steps S88, S89, S74, S76 and S77 so that any one of the cooking menus of "PIZZA," "COOKIE" and "CREAM PUFF" is selected in accordance with the determined food (steps S73, S75 and S78). In steps S74 and S77, the height anti weight of the food on the upper and lower top plates 44, 45 are detected.

When determining the cooking menu as described above, the microcomputer 67 advances to step S68 where the cooking is controlled in accordance with the set temperature and time period of the selected cooking menu in the manner as described above. The cooking is completed upon lapse of the set time period.

Oven Mode in Use of Rotative Top Plate 46

This cooking mode is directed to the cooking menus wherein the food is uniformly heated by turning the food so that the heated air is evenly applied to the food, and includes the cooking menus of "POUND CAKE," "PUDDING," "BREAD," "MEAT LOAF," "QUICHE," "SPONGE CAKE/POUND CAKE,"

"APPLE PIE," "ROAST BEEF," and "ROAST PORK." In the cooking menu of "BREAD," the dough is baked into bread.

Determination of Quiche and Apple Pie

Upon execution of this cooking mode, the microcomputer 67 executes step S93 where the height of the food is determined on the basis of the detection signal generated by the sixth photosensor 56, as is shown in the flowchart of FIG. 30(*b*). In this case, the rotative top plate 46 is being turned as the result of execution of step S8.

The quiche and apple pie are lower than the peripheral wall of the rotative top plate 46 in the above-described nine kinds of foods. When the sixth photosensor 56 is on at step S93, the microcomputer 67 determines that the food is low, advancing to step S94 where the oven heater 6 and the fan motor 16 are energized so that the atmosphere in the heating chamber 4 is heated. Upon lapse of a predetermined time period, the microcomputer 67 executes step S95 where it is determined whether alcohol has been detected by the alcohol sensor 60 or not.

In the case of quiche and apple pie, the alcoholic content is evaporated when the apple pie is heated while almost no alcoholic content is evaporated in the case of quiche. When the alcohol concentration is below a reference value, the microcomputer 67 determines at step S95 that the food is a quiche, advancing to step S96 where the cooking menu of "QUICHE" is selected. When the alcohol concentration is at the reference value or above, the microcomputer 67 determines that the food is an apple pie, advancing to step S97 where the cooking menu of "APPLE PIE" is selected. After selection of the cooking menu of "QUICHE" or "APPLE PIE," the microcomputer 67 executes step S68.

Determination of Bread

When the sixth photosensor 56 is on at step S93 where the height of the food is determined, the microcomputer 67 determines that the food is high, advancing to step S98 where it is determined whether or not the food is very high, on the basis of the fourth photosensor 54. Very high foods include the bread. Since the dough is put into the high metal container, fermented and baked in the case of the bread, the optical path of the fourth photosensor 54 is blocked by the metal container. When the fourth photosensor 54 is off at step S98, the microcomputer 67 determines that the food is high and that the food is bread, advancing to step S99 where the cooking menu of "BREAD" is selected. The microcomputer 67 then advances to step S67 where the heating is initiated, and thereafter, executes step S68.

Determination of Pudding

When the fourth photosensor 54 is on at step S98, the microcomputer 67 determines that the food is not very high, advancing to step S100. At step S100, the microcomputer 67 determines whether or not the number of pieces of the food is five or above, on the basis of output signal from the reflection-type photosensor 59.

As understood from FIG. 26(*b*), the reflection type photosensor 59 receives the light at the number of times in accordance with the number of pieces of the food per turn of the rotative top plate 46. Accordingly, the number of pieces of the food can be detected by counting the number of peaks of the signal generated by the photosensor 59 during one turn of the rotative top plate 46. In the case of "PUDDING," five or more pieces of pudding are cooked once. Accordingly, when the signal of the photosensor 59 whose magnitude varies in accordance with the intensity of the reflected light reaches its peak at five times or more, the microcomputer 67 determines that the number of pieces of the food is five or above and that the food is pudding. The microcomputer 67 then advances to step S101 where the cooking menu of "PUDDING" is selected. The microcomputer 67 advances to step S67 where the heating is initiated and subsequently, executes step S68.

Determination of Pound Cake

When it is determined at step S100 that the number of pieces of the food is below five, the microcomputer 67 advances to step S102 where an outer peripheral configuration of the food or of the container containing the food in the embodiment is determined from the number of times of peaks of the signal generated by the reflection type photosensor 59.

In baking the pound cake, the dough is put into a square metal cake mold 77 and baked, as shown in FIG. 26(*a*). Accordingly, the reflection type photosensor 59 receives the light reflected on four sides of the cake mold 77 per turn of the rotative top plate 46 and its signal reaches its peak four times. When the signal of the photosensor 59 reaches its peak four times per turn of the rotative top plate 46 at step S102, the microcomputer 67 determines that the food is a pound cake, advancing to step S103 where the cooking menu of "POUND CAKE" is selected. The microcomputer 67 then advances to step S67 where the heating is initiated and subsequently, executes step S68.

Determination of Meat Loaf

When the number of times of peak of the signal of the photosensor 59 per turn of the rotative top plate 46 is below or above four at step S102, the microcomputer 67 advances to step S104 where it is determined whether or not the weight of the food based on the weight detected by the weight sensor 39 is one kilogram or above. Since the meat loaf usually weighs one kilogram or above, the microcomputer 67 determines at step S104 that the food is a meat loaf, when the food weighs one kilogram or above. The microcomputer 67 then advances to step S67 where the heating is initiated and subsequently, executes step S68.

Determination of Sponge Cake

When the weight of the food is below one kilogram at step S104, the microcomputer 67 advances to step S106. At step S106, the outer peripheral configuration of the food is determined on the basis of the signal generated by the reflection type photosensor 59 or whether the cylindrical container is used or not is determined in the embodiment in the same manner as in step S102.

In baking the sponge cake, the dough is put into a cylindrical metal cake mold. The intensity of the light received by the photosensor 59 is high in the case of this cylindrical metal cake mold. Furthermore, the light intensity scarcely changes. Consequently, the signal generated by the photosensor 59 has a uniform high magnitude. Accordingly, when the signal of the photosensor 59 is larger than the reference value and has an approximately uniform magnitude, the microcomputer 67 determines that the cylindrical metal container is used and the food is a sponge cake, advancing to step S103 where the cooking menu of "SPONGE CAKE" is selected. The microcomputer 67 then advances to step S67 where the heating is initiated and subsequently, executes step S68.

Determination of Roast Beef and Roast Pork

When it is determined from the signal of the photosensor 59 that the metal container is not used, at step S106, the microcomputer 67 advances to step S107 where it is determined whether alcohol has been detected by the alcohol sensor 60 or not. Alcohol evaporates from the pork at the room temperature since it is immersed in liquor for preparation. However, the alcohol does not evaporates from the beef since it is not immersed in liquor for preparation. Accordingly, when alcohol has been detected at step S107, the microcomputer 67 determines that the food is pork, advancing to step S108 where the cooking menu of "ROAST PORK" is selected. When the alcohol has not been detected at step S107, the microcomputer 67 determines that the food is beef, advancing to step S109 where the cooking menu of "ROAST BEEF" is selected. After selecting the cooking menu of "ROAST BEEF" or "ROAST PORK," the microcomputer 67 advances to step S67 where the heating is initiated and subsequently, executes step S68.

The cooking menu is selected on the basis of the results of determination of the food as described above. After initiation of the heating, the microcomputer 67 advances to step S68 where the heating temperature and time period are set in accordance with the selected cooking menu. The cooking is completed upon lapse of the set time period.

In accordance with the above-described embodiment, the used cooking utensil differs in the cooking modes. The cooking utensil disposed in the heating chamber 4 is first determined so that the cooking mode intended by the user is automatically determined. On the other hand, the cooking mode is selected by operation of the switches in the prior art. Thus, differing from the setting of the cooking mode in the prior art, the setting of the cooking mode can be automatically performed without failure and accordingly, the troublesomeness due to the cooking mode selecting and setting operations performed by the user one by one can be prevented.

Two kinds of top plates, that is, the upper and lower top plates 44, 45 are used. The lower top plate 45 is used only in the oven mode and the upper top late 44 is used in both the oven and grill modes. However, the heater cooking mode is first selected on the basis of the detection of either one or both of the top plates. Then, when the heater cooking mode has been selected on the basis of the detection of the upper top plate 45, either the oven mode or the grill mode is then selected on the basis of presence or absence of the gridiron 47. Consequently, the cooking mode can be selected without failure and the distinction between the oven and grill modes can be particularly performed reliably, which increases the range of automatic selection of the cooking modes.

After the setting of the cooking mode, the food contained in the heating chamber 4 is automatically determined on the basis of various detection information and the cooking menu is selected so that the heating is controlled in accordance with the determined food. Consequently, the troublesomeness caused by the user selecting and setting a desired cooking mode from a number of cooking modes can be prevented. Furthermore, the determination of the food is performed after the setting of the cooking mode. Accordingly, a concrete food can be determined within a limited group of foods cooked in the set cooking mode. Consequently, the determination of the food and the selection of the cooking menu can be performed without failure. Thus, by a single operation for initiating the cooking, a desired cooking mode can be selected and the food can be automatically determined such that the heating can be automatically executed in accordance with the determined food.

Heat sources for the oven or grill modes may be gas burners.

The foregoing disclosure and drawings are merely illustrative of the principles of the present invention and are not to be interpreted in a limiting sense. The only limitation is to be determined from the scope of the appended claims.

We claim:

1. A microwave oven comprising:

a) a heating chamber;

b) a plurality of cooking utensils detachably disposed in the heating chamber selectively in accordance with cooking contents, the cooking utensils including at least an upper top plate and a lower top plate disposed up and down in the heating chamber respectively and a food holder placed on the upper top plate;

c) a plurality of heat sources for heating food placed on or contained in at least one of the cooking utensils, the heat sources including a magnetron, an oven heater and a grill heater;

d) cooking utensil detecting means for detecting the cooking utensil disposed in the heating chamber;

e) cooking mode selecting means connected to the cooking utensil detecting means for selecting one of a plurality of cooking modes in accordance with a result of detection by the cooking utensil detecting means, the cooking mode selecting means selecting a microwave cooking mode when the result of detection by the cooking utensil detecting means indicates that neither the upper nor the lower top plate is present in the heating chamber, the cooking mode selecting means selecting a heater cooking mode when the result of detection by the cooking utensil detecting means indicates that either the upper or the lower top plate is present in the heating chamber, the cooking mode selecting means further selecting either an oven mode or a grill mode on the basis of presence or absence of the food holder on the upper top plate when the heater cooking mode is selected; and f) control means connected to the cooking mode selecting means for controlling any one of the magnetron, the oven heater and the grill heater in accordance with the cooking mode selected by the cooking mode selecting means on the basis of a cooking program according to the selected cooking mode.

2. A microwave oven of claim 1, wherein the cooking mode selecting means selects the oven mode in use of both the upper and the lower top plates, the oven mode in use of the upper top plate, and the oven mode in use of the lower top plate when the result of detection by the cooking utensil detecting means shows that both the upper and the lower top plates are present in the heating chamber, that only the upper top plate is present in the heating chamber, and that only the lower top plate is present in the heating chamber, respectively.

3. A microwave oven of claim 1, wherein the food holder placed on the upper top plate includes a gridiron.

4. A microwave oven of claim 3, wherein the cooking mode selecting means selects the grill mode when the result of detection by the cooking utensil detecting means indicates that the gridiron is present on the upper top plate and the cooking mode selecting means selects the oven mode when the result of detection by the cooking utensil detecting means shows that the gridiron is absent on the upper top plate.

5. A microwave oven of claim 1, 2, 3 or 4, wherein each top plate is formed into the shape of a dish, which further comprises a height sensor connected to the control means for detecting the height of the food placed on either top plate relative to the height of a peripheral wall of either top plate, and wherein the control means determines the kind of the food on the basis of a result of detection by the height sensor and selects and executes a cooking menu in the oven mode in accordance with a result of determination about the kind of the food.

6. A microwave oven of claim 5, further comprising an alcohol sensor connected to the control means for detecting alcohol present in the heating chamber and wherein the control means determines the kind of the food on the basis of the height of the food when the height sensor has detected the height of the food higher than the peripheral wall of the top plate and that the control means determines the kind of the food on the basis of concentration of alcohol detected by the alcohol sensor after initiation of heating when the height sensor has detected the height of the food lower than the peripheral wall of the top plate, thereby selecting and executing the cooking menu in the oven mode in accordance with a result of the determination.

7. A microwave oven of claim 1, 2, 3 or 4, further comprising an alcohol sensor connected to the control means for detecting alcohol present in the heating chamber, a number sensor connected to the control means for detecting the number of pieces of food placed on either top plate, and a weight sensor connected to the control means for detecting the weight of the food placed on either top plate, and wherein the control means classifies the food into a specific kind of food and any other kinds of foods, on the basis of concentration of alcohol detected by the alcohol sensor and the number of food pieces detected by the number sensor, the control means determining the kind of the food on the basis of the weight of the food detected by the weight sensor when having classified the food into said any other kinds of foods, thereby selecting and executing the cooking menu in the oven mode in accordance with results of the determination.

8. A microwave oven of claim 1, 3, or 4, further comprising an alcohol sensor connected to the control means for detecting alcohol present in the heating chamber and wherein the control means determines that the food belongs to a specific cooking group, when the presence of alcohol is detected by the alcohol sensor before initiation of heating to the food after execution of the cooking program for the grill mode has been initiated, thereby selecting and executing the cooking menu in the specific cooking group.

9. A microwave oven of claim 8, wherein the control means determines the kind of the food on the basis of concentration of alcohol detected by the alcohol sensor after initiation of the heating, when having determined that the food belongs to a group other than the specific cooking group, thereby selecting and executing the cooking menu in accordance with a result of the determination.

10. A microwave oven of claim 9, further comprising a weight sensor connected to the control means for detecting the weight of the food, photographing means connected to the control means for photographing the food from above, and image processing means connected to the control means for calculating an area of the food from image information supplied thereto from the photographing means and wherein the control means determines the kind of the food on the basis of concentration of alcohol detected by the alcohol sensor after initiation of heating, the weight of the food detected by the weight sensor and the calculated area of the food when having determined that the food belongs to a group other than the specific cooking group, thereby selecting and executing the cooking menu in the grill mode in accordance with a result of determination.

11. A microwave oven of claim 10, further comprising a humidity sensor connected to the control means for detecting the humidity in the heating chamber and wherein the control means determines the kind of the food on the basis of concentration of alcohol detected by the alcohol sensor after initiation of heating, the weight of the food detected by the weight sensor, the calculated area of the food and the humidity detected by the humidity sensor, thereby selecting and executing the cooking menu in the grill mode in accordance with a result of determination.

12. A microwave oven of claim 8 further comprising a weight sensor connected to the control means for detecting the weight of the food, photographing means connected to the control means for photographing the food from above and image processing means connected to the control means for calculating an area of the food from information of image from the photographing means and wherein the control means determines the kind of the food on the basis of the weight and the area of the food when having determined that the food belongs to a group other than the specific cooking menus, thereby selecting and executing the cooking menu in the grill mode in accordance with the result of determination.

13. A microwave oven comprising:

a) a heating chamber;

b) a magnetron and a heater each heating food accommodated in the heating chamber;

c) a plurality of heat cooking utensils detachably disposed in the heating chamber, the cooking utensils including top plates used in the heating by the heater and a plurality of microwave cooking utensils used in the heating by the magnetron selectively in accordance with cooking contents;

d) cooking utensil detecting means for detecting the cooking utensil disposed in the heating chamber;

e) cooking mode selecting means connected to the cooking utensil detecting means for selecting a heater cooking mode when the result of detection by the cooking utensil detecting means indicates that the top plate is present in the heating, chamber, and for selecting any one of a warming mode, a thawing mode and a pot-used cooking mode in accordance with the result of detection of the microwave cooking utensil by the cooking utensil detecting means when the result of detection by the cooking utensil detecting means indicates that one of the microwave cooking utensils is present in the heating chamber; and f) control means connected to the cooking mode selecting means for controlling either the magnetron or the heater in accordance with the cooking mode selected by the cooking mode selecting means on the basis of a cooking program according to the selected cooking mode.

14. A microwave oven of claim 13, further comprising an alcohol sensor connected to the control means for detecting alcohol present in the heating chamber before initiation of heating by the magnetron and a height sensor connected to the control means for detecting the height of a receptacle containing food and wherein the control means determines that the food contained in the receptacle is Japanese sake, when the presence of alcohol has been detected and that the food contained in the receptacle is milk, when the absence of alcohol has been detected and the height of the receptacle detected by the height sensor has been at a predetermined value or above, thereby executing the cooking menu in accordance with a result of determination.

15. A microwave oven of claim 14, further comprising a color sensor connected to the control means for detecting that the food is white, and wherein the control means classifies the food contained in the receptacle into a white beverage and any kinds of foods other than the white beverage, on the basis of detection by the color sensor when no alcohol has been detected by the alcohol sensor and the height of the receptacle detected by the height sensor has been below the predetermined value, thereby executing the cooking menu of the warming mode in accordance with a result of classification.

* * * * *